US007860429B2

(12) United States Patent
Ishikawa et al.

(10) Patent No.: US 7,860,429 B2
(45) Date of Patent: Dec. 28, 2010

(54) CLEANING DEVICE AND IMAGE FORMING APPARATUS USING THE SAME

(75) Inventors: Takatoshi Ishikawa, Kanagawa (JP); Nobuo Hyakutake, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 419 days.

(21) Appl. No.: 11/402,838

(22) Filed: Apr. 13, 2006

(65) Prior Publication Data

US 2007/0059027 A1 Mar. 15, 2007

(30) Foreign Application Priority Data

Sep. 9, 2005 (JP) ..... P2005-262366
Sep. 12, 2005 (JP) ..... P2005-263599
Sep. 12, 2005 (JP) ..... P2005-264017

(51) Int. Cl.
*G03G 15/16* (2006.01)

(52) U.S. Cl. ..... 399/101; 399/297; 399/302; 399/353; 399/354; 399/357; 399/359; 399/360

(58) Field of Classification Search ..... 399/101, 399/99, 297, 302, 353–354, 357, 359–360
See application file for complete search history.

(56) References Cited

U.S. PATENT DOCUMENTS 4,469,435 A * 9/1984 Nosaki et al. ..... 399/148
4,999,679 A * 3/1991 Corbin et al. ..... 399/354
5,233,398 A * 8/1993 Nimura et al. ..... 399/354
5,257,079 A * 10/1993 Lange et al. ..... 399/354
5,329,344 A * 7/1994 Gerbasi et al. ..... 399/353
5,416,572 A * 5/1995 Kolb et al. ..... 399/350
5,623,721 A * 4/1997 Lindblad et al. ..... 399/354
5,652,951 A * 7/1997 Thayer et al. ..... 399/71

(Continued)

FOREIGN PATENT DOCUMENTS

JP 10-26918 1/1998

(Continued)

OTHER PUBLICATIONS

English translation of JP pub # 11-219048 Asakura, et al. published Aug. 10, 1999.*

(Continued)

*Primary Examiner*—David M Gray
*Assistant Examiner*—Geoffrey T Evans
(74) *Attorney, Agent, or Firm*—Morgan, Lewis & Bockius LLP

(57) ABSTRACT

A cleaning device, comprises: a plurality of brush rolls being contact with a surface of the image carrier that a toner is attached; and a biasing unit applying bias voltages having different polarities from each other to at least two of the brush rolls, the plurality of brush rolls including a first brush roll and a second brush roll, a bias having a polarity opposite to a normal polarity of the toner being applied to the first brush roll, a bias having the same polarity as the normal polarity of the toner being applied to the second brush roll, a surface circulating speed of the first brush roll being set to be higher than the surface circulating speed of the second brush roll.

4 Claims, 27 Drawing Sheets

U.S. PATENT DOCUMENTS

| | | | | |
|---|---|---|---|---|
| 6,731,899 | B2 * | 5/2004 | Takahata et al. | 399/302 |
| 7,103,304 | B2 * | 9/2006 | Hara | 399/176 |
| 7,127,191 | B2 * | 10/2006 | Mori et al. | 399/101 |
| 7,215,920 | B2 * | 5/2007 | Shida | 399/354 |
| 7,251,430 | B2 * | 7/2007 | Nishikawa | 399/71 |
| 7,395,004 | B2 * | 7/2008 | Nishikawa | 399/71 |
| 7,403,729 | B2 * | 7/2008 | Shida | 399/71 |
| 7,444,098 | B2 * | 10/2008 | Hamada et al. | 399/101 |
| 7,693,441 | B2 * | 4/2010 | Nishikawa | 399/71 |
| 2005/0232667 | A1 * | 10/2005 | Iwata | 399/353 |
| 2010/0143010 | A1 * | 6/2010 | Shirai et al. | 399/354 |
| 2010/0150601 | A1 * | 6/2010 | Sano et al. | 399/101 |
| 2010/0150602 | A1 * | 6/2010 | Sano et al. | 399/101 |

FOREIGN PATENT DOCUMENTS

| | | |
|---|---|---|
| JP | 11-219048 | 8/1999 |
| JP | 2005250039 A * | 9/2005 |

OTHER PUBLICATIONS

English translation of Ishikawa et al. (JP pub 2005-250039).*

* cited by examiner

CLEANING DEVICE AND IMAGE FORMING APPARATUS USING THE SAME

CROSS-REFERENCE TO RELATED APPLICATIONS

This application is based on and claims the benefit of priority from the prior Japanese Patent Applications No. 2005-262366, filed on Sep. 9, 2005, No. 2005-263599, filed on Sep. 12, 2005, and No. 2005-264017, filed on Sep. 12, 2005; the entire contents of which are incorporated herein by reference.

TECHNICAL FIELD

The present invention relates to an image forming apparatus, such as a printer or a copier using an electrophotographic method, a fax machine, or a complex machine thereof, and a cleaning device used for the same. In particular, the present invention relates to a cleaning device for cleaning a surface of an image carrier and an image forming apparatus equipped with the same, in which the image forming apparatus primarily transfers a toner image formed on an image carrier to an intermediate image carrier and secondarily transfers the toner image to a recording medium, or the image forming apparatus directly transfers the toner image to the recording medium to form an image.

RELATED ARTS

An image forming apparatus, such as a printer or a copier using an electrophotographic method, a fax machine, or a complex machine thereof, forms a toner image on an image carrier such as a photosensitive drum, and directly transfers the toner image formed on the image carrier to a recording medium such as a paper.

In addition, there is a four-cycle type image forming apparatus which includes an image carrier such as a single photosensitive drum, sequentially forms toner images of colors of yellow (Y), magenta (M), cyan (C), and black (K) on the image carrier, primarily transfers the toner images of colors of yellow (Y), magenta (M), cyan (C), and black (K) sequentially formed on the image carrier to an intermediate transfer belt serving as another image carrier, and secondarily transfers the toner images from the intermediate transfer belt to a recording medium such as a paper to form a full-color image.

In addition, there is a tandem type image forming apparatus which includes an image forming unit for the colors of yellow (Y), magenta (M), cyan (C), and black (K), primarily transfers toner images formed on a photosensitive drum serving as an image carrier provided on the image forming unit for the colors of yellow (Y), magenta (M), cyan (C), and black (K) to an intermediate transfer belt serving as another image carrier, and secondarily transfers the toner images of the colors of yellow (Y), magenta (M), cyan (C), and black (K) transferred to the intermediate transfer belt to a recording medium such as a paper to form a full-color image.

The image forming apparatus configured in this manner includes a cleaning device which cleans a transfer residual toner remaining on the photosensitive drum after transferring the toner images formed on the photosensitive drum to the recording medium, such as a paper, or the intermediate transfer belt, or a cleaning device which cleans a transfer residual toner remaining on the intermediate transfer belt after secondarily transferring the toner images of the colors of yellow (Y), magenta (M), cyan (C), and black (K) primarily transferred on the intermediate transfer belt to the recording medium such as a paper.

In addition, in the image forming apparatus, when a paper is jammed during an image forming operation, the toner image carried on the photosensitive drum or intermediate transfer belt is not transferred to the intermediate transfer belt or the paper but remains on the photosensitive drum or intermediate transfer belt. Thus, the non-transfer toner remaining on the photosensitive drum or intermediate transfer belt needs to be cleaned by the cleaning device.

In the image forming apparatus, a toner having a polarity opposite to a normal polarity in a developer is generated when a carrier in the developer is deteriorated as time elapses. The toner having the opposite polarity is developed and attached as a blushing toner on a non-image part of an image carrier. Thus, the image forming apparatus needs to remove the blushing toner as well as the toner having a normal polarity (for example, a negative polarity) by the cleaning device.

In the above-mentioned four-cycle type or tandem type image forming apparatus, there is a toner attached due to a phenomenon called "retransfer", in which part of a toner image of each of colors of yellow (Y), magenta (M), cyan (C), and black (K) transferred on the intermediate transfer belt from the photosensitive drum is reverse-transferred to the photosensitive drum. The retransfer toner is a toner electrified with a reverse polarity since it receives discharge for transfer by a second transfer part. In addition, the retransfer toner has a strong adhesive force to the photosensitive drum, which is caused by electrostatic force.

On the surface of the image carrier such as the photosensitive drum or the intermediate transfer belt, there is a toner having almost no electrified charge due to the discharge for transfer even though it is not electrified with an opposite polarity by the discharge for transfer. The toner having almost no electrified charge flows in the cleaning device as a retransfer toner that is reverse-transferred due to an electrostatic adhesive force to the surface of the photosensitive drum when the transfer residual toner or toner image of another color is transferred. However, since the retransfer toner has almost no electrified charge, it is difficult to perform a cleaning operation in the cleaning device that removes the toner by electric field.

The cleaning device for cleaning an intermediate image carrier such as an intermediate transfer belt cleans the transfer residual toner similar to the photosensitive drum. However, only a monochrome toner image exists on the photosensitive drum, whereas a multi-colored toner image is transferred to the intermediate image carrier, therefore, a large amount of transfer residual toner exists and a high transfer electric field is applied to a transfer part. Thus, The intermediate image carrier is easily affected by discharge, and the transfer residual toner has a wide electrification distribution, as a result, an adhesive force to the intermediate transfer unit becomes strong with ease. In addition, when a paper is jammed, because the toner that is not transferred to the paper, but to the intermediate transfer unit has a plurality of colors, a large amount of toner is required, therefore, it is necessary to clean a large amount of toner.

In addition, in the image forming apparatus, a toner image for concentration control or registration control is formed on a non-image part of the intermediate image carrier such as an intermediate transfer belt. The toner image for concentration control or registration control is mostly cleaned by a cleaning device for the intermediate image carrier.

The toner flowing into the cleaning device of the image carrier such as the photosensitive drum or the intermediate transfer belt has a wide distribution of the amount of toner or the electrified amount of toner. In the intermediate image carrier, since a multi-colored toner image is transferred and a transfer electric field is high, the distribution of the amount of toner or the electrified amount of toner is wider.

The cleaning device for cleaning the toner employs a blade cleaning method using a blade, or a brush cleaning method (electrostatic cleaning method) using a conductive brush roll. The cleaning device employing the blade cleaning method can clean a small amount or a large amount of toner. However, in case particles such as paper dust or carrier are mixed in the toner, a cleaning operation may be not properly performed, or a blade edge may be broken or abraded due to sliding friction with a surface of a member to be cleaned. Accordingly, it is difficult to maintain a reliable cleaning capability for a long term.

Conversely, the cleaning device employing the brush cleaning method using conductive brush roller does not suffer the above problems such as in the cleaning device employing the blade cleaning method. Accordingly, it can prevent the cleaning capability from being deteriorated.

However, in case of the cleaned member having a wide distribution of the amount of toner and the electrified amount of toner like the intermediate image carrier, since the charge amount of toner flowing into the cleaning device is diverse, it is difficult to clean the toner using only the electrostatic force generated in brush. In particular, the electrostatic force generated in the brush does not affect the toner having few electric charge due to discharge, so that it is difficult to clean the toner.

In case of the cleaning device employing the brush cleaning method, it is effective to set the circulating speed of a surface of a brush roll to be high so as to increase a mechanical scraping force. However, in case of increasing the surface circulating speed with a single brush, it is easy to clean a large amount of toner. However, when the amount of toner is small, the toner is easily evaded and the amount of toner cloud is increased, thus causing the toner to be easily attached again.

When the circular speed of a brush is changed at the time of paper passing and at the time of paper non-passing in a normal image forming process, a transition period is required until the brush reaches a desired circulating speed. Thus, it is not possible to perform a cleaning operation during the transition period, and the productivity in image forming is reduced. Accordingly, it is not possible to apply a high-speed image forming apparatus.

In the cleaning device for the intermediate transfer unit, it is required to clean a transfer residual toner having a wide distribution of the amount of toner for a single color through a plurality of colors. In addition, in a paper having low transfer efficiency like a water-containing paper in a hot and humid environment, the amount of transfer residual toner increases. Thus, the distribution of the amount of toner is extended, and changing the circular speed of the brush is not enough to deal with it.

FIG. 27 shows an image forming apparatus according to the related art. In the image forming apparatus, after a toner image formed on a photoconductor body 701 is repeatedly transferred onto the intermediate transfer belt 710 and is superimposed on the intermediate transfer belt 710, the superimposed toner image is collectively transferred onto the recording material.

Around the photoconductor body 701, there are arranged an electrifying roller 702 which electrifies the photoconductor body 701, a laser exposing device 703 which forms a latent image on the electrified photoconductor body 701, a developing device 704 which develops an electrostatic latent image on the photoconductor body 701, and a primary transfer roller 705 which transfers the toner image formed on the photoconductor body 701 onto the intermediate transfer belt 710.

The intermediate transfer belt 710, which is stretched by three stretch rollers 711 to 713, is constructed so as to cycle, with the stretch roller 711 being used as a driving roller. Further, a secondary transfer roller 714 which transfers the superimposed toner image formed on the intermediate transfer belt 710 onto a recording material is provided to be retractable with respect to the intermediate transfer belt 710, with the stretch roller 713 being used as a backup roller.

In the position opposite to the stretch roller 711, a cleaning device 720 is provided to be retractable.

Further, inside the cleaning device 720, a cleaning roller 722 is housed, which cleans two electrostatic brushes 721.

SUMMARY

The present invention has been made in view of the above-circumstances and provides a cleaning device.

According to an aspect of the invention, a cleaning device comprises: a plurality of brush rolls being contact with a surface of the image carrier that a toner is attached; and a biasing unit applying bias voltages having different polarities from each other to at least two of the brush rolls, the plurality of brush rolls including a first brush roll and a second brush roll, a bias having a polarity opposite to a normal polarity of the toner being applied to the first brush roll, a bias having the same polarity as the normal polarity of the toner being applied to the second brush roll, a surface circulating speed of the first brush roll being set to be higher than the surface circulating speed of the second brush roll.

BRIEF DESCRIPTION OF THE DRAWINGS

The embodiment of the invention will become more fully apparent from the following detailed description taken with the accompanying drawings in which.

DESCRIPTION OF EMBODIMENTS

Embodiments according to the present invention will be described in detail with reference to the accompanying drawings.

First Embodiment

Figure 2:
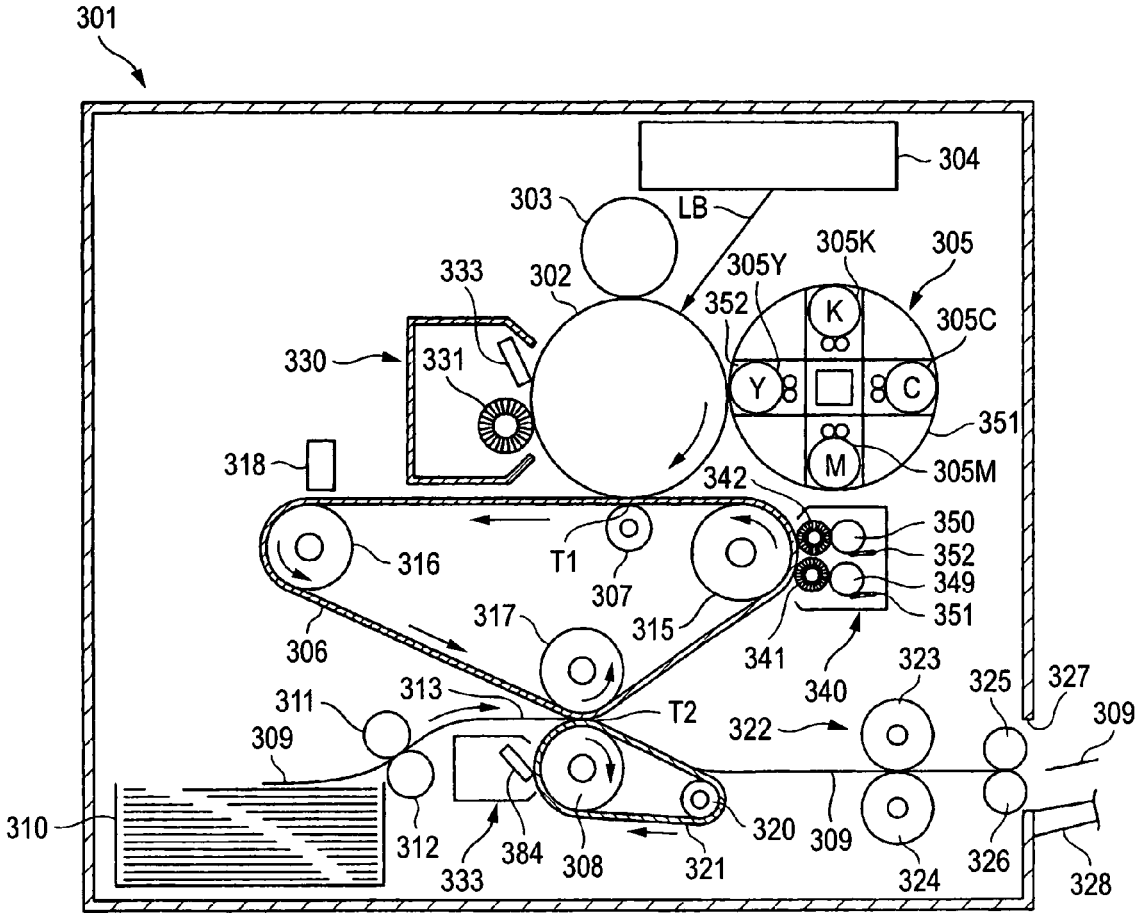
FIG. 2 is a schematic view showing a full-color printer serving as an image forming apparatus equipped with a cleaning device according to the first embodiment.

FIG. 2 is an image forming apparatus equipped with a cleaning device according to a first embodiment of the present invention, in which the image forming apparatus is a four-cycle full-color printer.

Referring to FIG. 2, reference numeral 301 denotes a main body of a full-color printer. The main body 301 of the full-color printer includes a photosensitive drum 302, which is rotatably provided as an image carrier, on its upper central portion. The photosensitive drum 302 is formed of, for example, a conductive cylindrical member coated with a photosensitive layer made of OPC, and is rotated at a process speed of about 220 mm/sec in an arrow direction by a driver (not shown). The full-color printer has a relatively high process speed of about 220 mm/sec and a high productivity in the same type of color printer. In addition, the process speed of the full-color printer may be set to be higher than 220 mm/sec, for example, in a black-and-white mode. Further, it should be understood that the process speed may be adapted to a slower or faster machine than the full-color printer.

A surface of the photosensitive drum 302 is electrified to a predetermined potential (for example, a negative potential) by an electrifying roll 303, which is disposed on the photosensitive drum 302 as a first electrifier. The surface of the photosensitive drum 302 is subjected to an image exposure by a laser beam (LB) using a ROS4 (Raster Output Scanner) as an exposure unit, which is disposed on an upper side of the photosensitive drum 302, such that an electrostatic latent image based on image information of four colors of yellow (Y), magenta (M), cyan (C), and black (K) is sequentially formed. The electrostatic latent image formed on the photosensitive drum 302 is developed by a rotary developing device 305 including four developers 305Y, 305M, 305C, and 305K for four colors of yellow (Y), magenta (M), cyan (C), and black (K), respectively, and becomes a predetermined color of toner image.

As shown in FIG. 2, the rotary developer 305 includes the four developers 305Y, 305M, 305C, and 305K for four colors of yellow (Y), magenta (M), cyan (C), and black (K), respectively, which are provided at right angles to each other along the circumference of a rotary drum 351. The four developers 305Y, 305M, 305C, and 305K for four colors of yellow (Y), magenta (M), cyan (C), and black (K), respectively, are configured such that a development roll 352 of each of the developers 305Y, 305M, 305C, and 305K stops at a developing position facing the photosensitive drum 302 and the electrostatic latent image formed on the photosensitive drum 302 is developed by a toner having a desired color by controlling a rotating position of the rotary drum 351.

In addition, a toner cartridge (not shown) is mounted on each of the four developers 305Y, 305M, 305C, and 305K for four colors of yellow (Y), magenta (M), cyan (C), and black (K) to be adjacent to each of the four developers 305Y, 305M, 305C, and 305K, or is mounted on the main body 301 of the full-color printer. The concentration of toner in each of the developers 305Y, 305M, 305C, and 305K can be controlled within a predetermined range by supplying a developing agent including the toner or carrier from the toner cartridge to each of the developers 305Y, 305M, 305C, and 305K in a predetermined timing.

Each of the developers 305Y, 305M, 305C, and 305K for four colors of yellow (Y), magenta (M), cyan (C), and black (K) may use any toner, such as a polymerization toner or a pulverized toner, and any shape, such as sphere or indefinite shape. In addition, the toner is electrified by stirring a two-component developing agent containing a carrier or a one-component developing agent containing no carrier within the developers 305Y, 305M, 305C, and 305K. The toner is set to have a negative electrical charge of −10~−60 μC/g.

The electrifying, exposing, and developing processes are repeatedly performed predetermined times on the surface of the photosensitive drum 302 according to the color of an image. The rotary developing device 305 is moved at a position in which the development roll 352 of the developers 305Y, 305M, 305C, and 305K of a corresponding color faces the photosensitive drum 302. For example, in case of forming a full-color image, the electrifying, exposing, and developing processes are repeatedly performed four times corresponding to the respective colors of yellow (Y), magenta (M), cyan (C), and black (K) on the surface of the photosensitive drum 302. Toner images corresponding to the respective colors of yellow (Y), magenta (M), cyan (C), and black (K) are sequentially formed on the surface of the photosensitive drum 302. The number of times the photosensitive drum 302 rotates in forming the toner image depends on the size of image, and the photosensitive drum 302 rotates to predetermined times, so that a single image is formed. That is, the toner images corresponding to the respective colors of yellow (Y), magenta (M), cyan (C), and black (K) are sequentially formed on the surface of the photosensitive drum 302 whenever the photosensitive drum 302 rotates to predetermined times.

The toner images of the respective colors of yellow (Y), magenta (M), cyan (C), and black (K) sequentially formed on the photosensitive drum 302 are primarily transferred by a primary transfer roll 307 at a primary transfer position T1 at which an intermediate transfer belt (intermediate transfer unit) 306 serving as an intermediate image carrier is contact with the periphery of the photosensitive drum 302. The toner images of the respective colors of yellow (Y), magenta (M), cyan (C), and black (K) transferred to the intermediate transfer belt 306 in multiple layers are secondarily collectively transferred by a second transfer roll 308 to a recording paper 309 serving as a recording medium supplied in a predetermined timing at a second transfer position T2. The recording paper 309 is output by a paper-feeding roller (not shown) from a paper-feeding cassette 310 provided on a lower side of the main body 301 of the full-color printer, at the same time, is fed one by one by a feed roll 311 and a retard roll 312. The recording paper 309 is carried to the second transfer position T2 of the intermediate transfer belt 306 by a resist roll (not shown) along a paper conveying path 313 in synchronization with the toner images transferred to the intermediate transfer belt 306.

The intermediate transfer belt 306 is suspended by a plurality of rolls and, while being contact with the surface of the photosensitive drum 302. The intermediate transfer belt 306 rotates in synchronization with the rotation of the photosensitive drum 302 to be circulated in a predetermined process speed (about 220 mm/sec). Even though the intermediate transfer belt 306 is made of a synthetic resin such as a polyimide resin having a dispersed carbon, it may be made of a polyamideimide resin or a PVDF resin. The intermediate transfer belt 306 is suspended to have a predetermined tension by a drive roll 315, the first transfer roll 307, a tension roll 316, and a backup roll 317.

Figure 3:
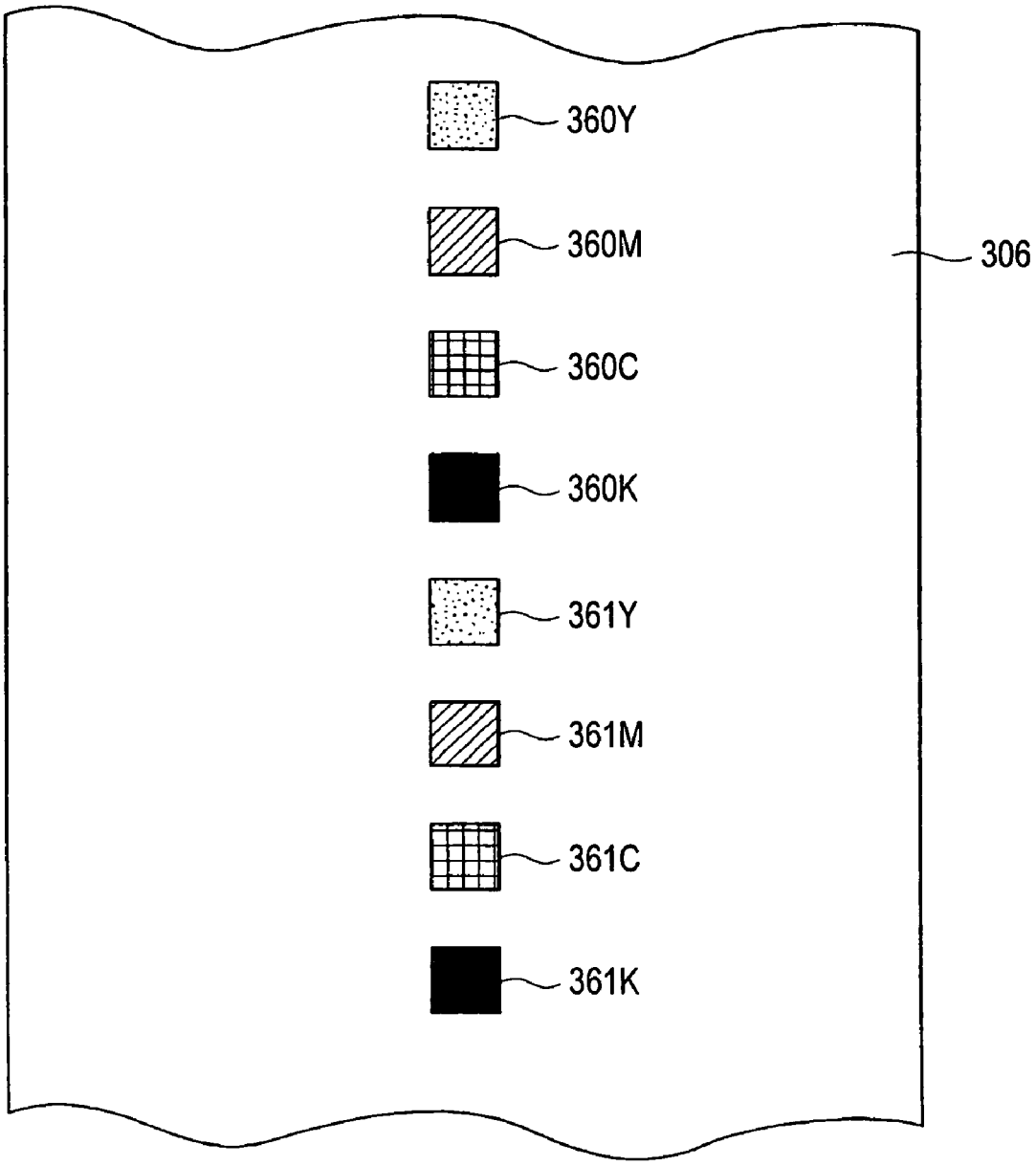
FIG. 3 is a view showing a toner image for concentration control.

As shown in FIG. 3, on an upstream of the tension roll 316 of the intermediate transfer belt 306, a sensor 318 is provided, which serves as a detection unit formed of a reflective photosensor detecting the concentration of the toner image 360Y, 360M, 360C, 360K or 361Y, 361M, 361C, 361K for concentration control or the concentration of a toner image (not shown) for registration control formed on the intermediate transfer belt 306.

In addition, as shown in FIG. 2, the recording paper 309 having the toner image transferred from the intermediate transfer belt 306 is carried to a fixing unit 322 by a carrying belt 321 suspended between the second transfer roll 308 and a carrying roll 320. The toner image is fixed on the recording paper 309 by heat and pressure applied from a heating roller 323 and a pressurizing roller 324 of the fixing unit 322. The recording paper 309 is discharged by discharge rolls 325 and 326 from a discharge outlet 327 to a discharge tray 328 provided on the main body 301 of the printer.

After the transfer process of the toner image, the toner remaining on the surface of the photosensitive drum 302 is removed by a cleaning device 330 provided on the photosensitive drum 302 to prepare for a next image forming process whenever the photosensitive drum 302 rotates one turn. The cleaning device 330 for the photosensitive drum includes a brush roll 331 and a cleaning blade 332.

In addition, a toner remaining on the carrying belt 321 suspended on the surface of the secondary transfer roll 308 is removed by a cleaning device 333. The cleaning device 333 for the secondary transfer roll includes a cleaning blade 334.

Even though the present embodiment is configured such that the recording paper 309 having the toner image transferred from the intermediate transfer belt 306 is carried to the fixing unit 322 by the carrying belt 321 suspended between the secondary transfer roll 308 and the carrying roll 320, an additional carrying belt may be provided to carry the recording paper 309 to the fixing unit 322.

In the present embodiment, the cleaning device for cleaning the toner attached on the surface of the image carrier includes a plurality of brush rolls, which is contact with the surface of the image carrier, and a biasing unit, which applies bias voltages having different polarities to at least two of the brush rolls. In the present embodiment, among the brush rolls, a brush roll, to which a bias voltage having a polarity opposite to a normal electrified polarity of the toner is applied, is set to be faster in surface circulating speed than a brush roll, to which a bias voltage having the same polarity as the normal electrified polarity of the toner is applied.

In addition, the present embodiment is configured such that each of the brush rolls is formed of a conductive brush, and rotates in the opposite direction to a movement of the image carrier.

In addition, the present embodiment is configured such that a first brush roll and a second brush roll, which are sequentially disposed from an upstream of the movement direction of the image carrier, are included, and a bias voltage having a polarity opposite to a normal electrified polarity of the toner is applied to the first brush roll and a bias voltage having the same polarity as the normal electrified polarity of the toner is applied to the second brush roll.

In addition, the present embodiment is configured such that the image carrier is an intermediate transfer unit.

That is, as shown in FIG. 2, in the present embodiment, removing a toner attached on the intermediate transfer belt 306 serving as the image carrier, a cleaning device 340 for an intermediate transfer belt is provided. The cleaning device 340 for the intermediate transfer belt is provided at a position corresponding to the intermediate transfer belt 306 wound on the periphery of a drive roll 315.

Figure 1:
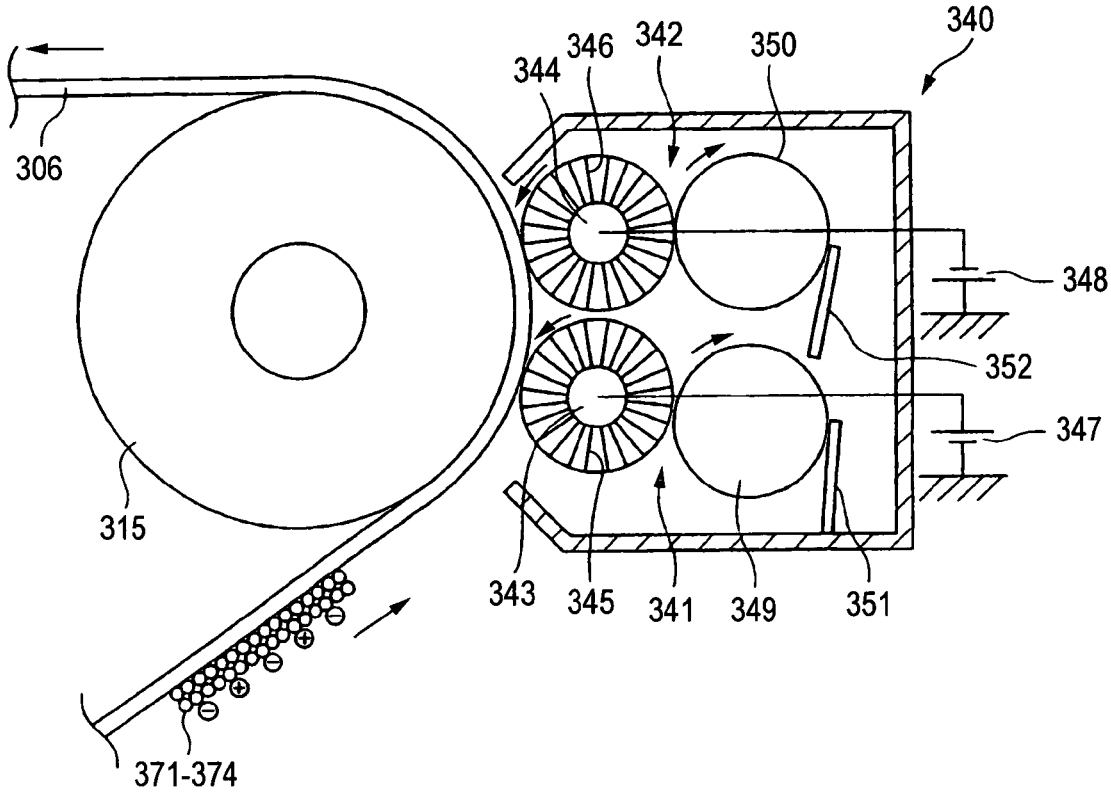
FIG. 1 is a schematic view showing a main part of a full-color printer serving as an image forming apparatus equipped with a cleaning device according to a first embodiment of the present invention.

As shown in FIG. 1, the cleaning device 340 for the intermediate transfer belt includes a plurality of brush rolls 341 and 342 (two brush rolls in the drawing) each formed of a conductive brush. Each of the first and second brush rolls 341 and 342 is configured to rotate at a different speed from that of the intermediate transfer belt 306 in a direction opposite to the movement direction of the intermediate transfer belt 306.

The speeds of the first and second brush rolls 341 and 342 are set such that the first brush roll 341 has a speed ratio R (brush speed/belt speed) of 1.0 (preferably, $0.5 \leqq R \leqq 1.5$) and the second brush roll 342 has a speed ratio of 0.1 (preferably, $0.05 \leqq R \leqq 0.5$). Both of or either of the first and second brush rolls 341 and 342 may be configured to rotate in the same direction as the movement direction of the intermediate transfer belt 306.

As shown in FIG. 1, each of the first and second brush rolls 341 and 342 is formed of a cylindrical brush in which brush fibers 345 and 346 having a predetermined diameter are planted with a predetermined density on the periphery of each of conductive shafts 343 and 344 made of metal or conductive synthetic resin. The brush fibers 345 and 346 used in the first and second brush rolls 341 and 342 are made of conductive fibers including a base material, such as nylon, acryl, polyester, or rayon, combined with a conductive material, such as carbon black. In the present embodiment, a conductive nylon is used. Even though each of the brush fibers 345 and 346 has a thickness of 6 deniers (D) in the present embodiment, the brush fiber having a thickness of 0.1~15 deniers may be used.

Each of the first and second brush rolls 341 and 342 has a brush density having more than a predetermined value to block the toner in a low speed. When the density is F [numbers/inch$^2$] and the thickness of fiber is D [denier], it is preferably set to F/D≧10. In the present embodiment, the thickness of fiber is set to 6 [deniers] and the density is 150 [numbers/inch$^2$], such that F/D=25.

The first and second brush rolls 341 and 342 can be set to various diameters. In the present embodiment, the brush has a diameter of 16 mm, the shaft has a diameter of 10 mm, and a length PH of brush including brush cloth is set to 3 mm. In addition, the bite amount DP of the first and second brush rolls 341 and 342 to the surface of the intermediate transfer belt 306 is set to 0.8 mm. In addition, the ratio of the bite amount DP to the length of brush PH is preferably set to 0.1≦DP/PH≦0.5.

Bias voltages having different polarities from each other are applied to the first and second brush rolls 341 and 342 by biasing units 347 and 348, respectively. A positive bias voltage (for example, about +300 V), which has a polarity opposite to the normal electrified polarity (negative polarity) of the toner, is applied to the first brush roll 341 disposed at an upstream of the movement direction of the intermediate transfer belt 306 by a DC voltage source 347 serving as a biasing unit. In addition, a negative bias voltage (for example, about −300 V), which has the same polarity as the normal electrified polarity (negative polarity) of the toner, is applied to the second brush roll 342 disposed at a downstream of the movement direction of the intermediate transfer belt 306 by a DC voltage source 348 serving as a biasing unit. It should be understood that the bias voltages applied to the first and second brush rolls 341 and 342 are not limited to the above-mentioned voltage values.

In addition, as shown in FIG. 1, the first and second brush rolls 341 and 342 are arranged to contact collecting rolls 349 and 350, respectively, which collect toner removed by the first and second brush rolls 341 and 342. The collecting rolls 349 and 350 are made of a synthetic resin, such as conductive phenol resin, or a metallic material. The collecting rolls 349 and 350 have a diameter ϕ of 12 mm and have a potential difference (voltage applied to the collecting roll—voltage applied to the brush) from the brush rolls 341 and 342. A potential difference of +400 V is set between the first brush roll 341 and the first collecting roll 349 by a voltage source (not shown), and a potential difference of −400 V is set between the second brush roll 342 and the second collecting roll 350 by a voltage source (not shown. The collecting rolls 349 and 350 have a speed different from the brush rolls 341 and 342. For example, the collecting rolls 349 and 350 are set to rotate at a speed of 1.3 times that of the brush rolls 341 and 342. The biting amount of the brush rolls 341 and 342 and the collecting rolls 349 and 350 are set to be greater than that of the brush rolls 341 and 342 and the belt 306. The biting amount is set to 0.9 mm in the present embodiment.

The toner collected by the first and second collecting rolls 349 and 350 is gathered by collecting roll blades 351 and 352. The collecting roll blades 351 and 352 are made of an elastic material, a resin material, or a metallic material. In the present embodiment, the collecting roll blades 351 and 352 are formed of a thin plate made of SUS having a thickness of 0.1 mm.

According to the full-color printer equipped with the cleaning device according to the present embodiment, it is possible to make the structure of the driver simple and compact, to remove the toner completely, and to be applied to a high-speed image forming apparatus.

That is, as shown in FIG. 2, in the full-color printer according to the present embodiment, the toner images of the colors of yellow (Y), magenta (M), cyan (C), and black (K) are sequentially formed on the photosensitive drum 302 through a well-known electronic photo process. The toner images of the colors of yellow (Y), magenta (M), cyan (C), and black (K) sequentially formed on the photosensitive drum 302 are primarily transferred on the intermediate transfer belt 306 at the primary transfer position T1, and are secondarily collectively transferred from the intermediate transfer belt 306 to the recording paper 309 by the secondary transfer roll 308 at the secondary transfer position T2.

Figure 4:
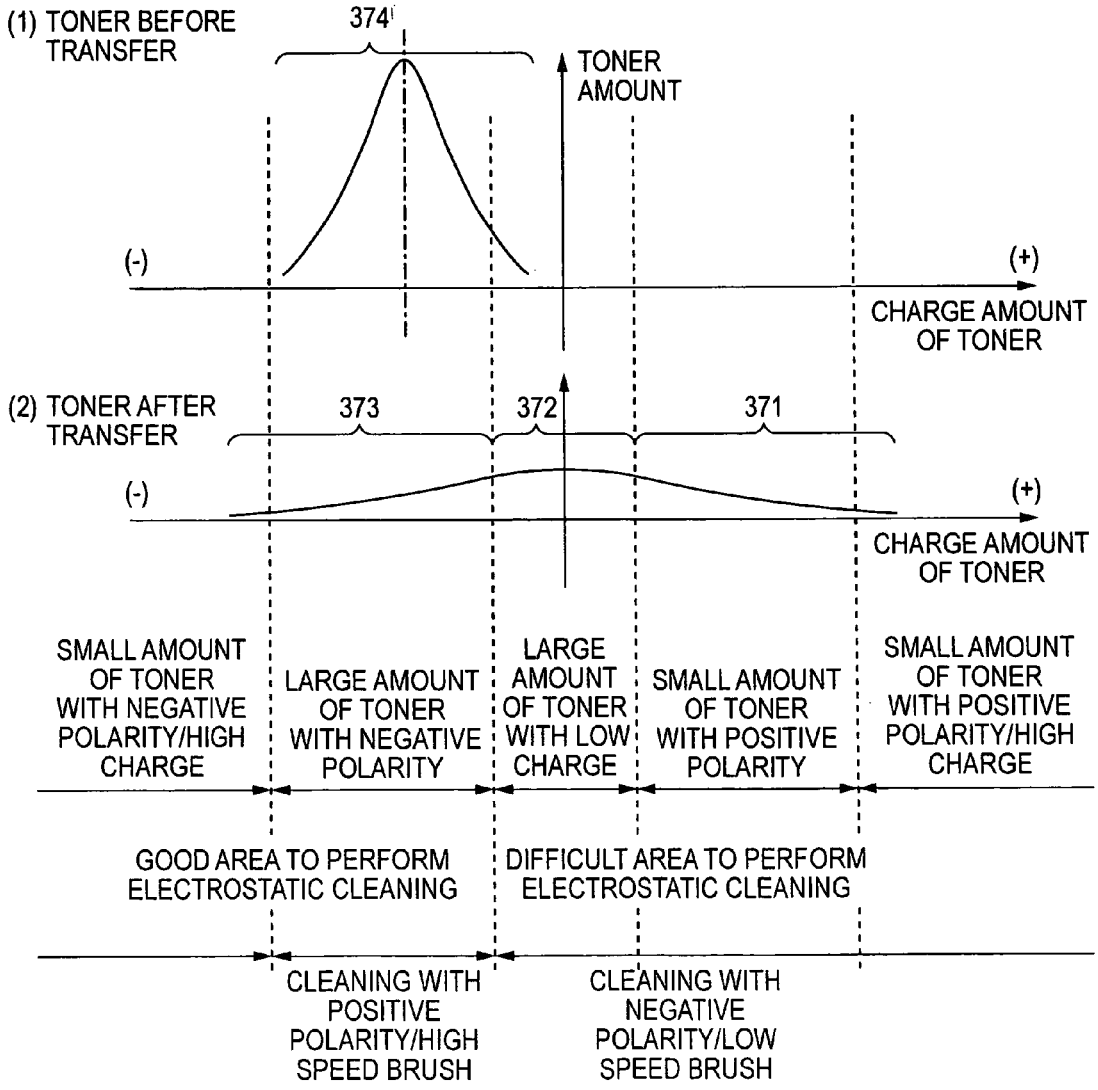
FIG. 4 is a graph showing distribution of the amount of toner remaining on an intermediate transfer belt and distribution of the electrified amount of the toner.

At this time, a very high bias voltage for transfer is applied to the secondary transfer roll 308 to collectively transfer the toner images of the colors of yellow (Y), magenta (M), cyan (C), and black (K) transferred on the intermediate transfer belt 306 to the recording paper 309, such that the toner images having multiple colors on the intermediate transfer belt 306 are transferred to the recording paper 309. As shown in FIG. 4, part of the multi-colored toner images carried on the intermediate transfer belt 306 is electrified to a positive polarity due to discharge generated by the very high bias voltage for transfer and is attached on the intermediate transfer belt 306, such that a transfer residual toner 371 having a negative polarity exists. In addition, even though the polarity is not reversed by the bias voltage for transfer, the amount of electrified charge is almost equal to zero, such that only a small amount of transfer residual toner 372 remains on the intermediate transfer belt 306.

As shown in FIG. 4, only a small amount of transfer residual toner 373 remains on the intermediate transfer belt 306 which is electrified with a negative polarity.

As shown in FIG. 3, in the full-color printer, when forming a non-image, the toner images 360Y, 360M, 360C, and 360K or 361Y, 361M, 361C, and 361K for concentration control, or toner images for registration control (not shown) are formed on the intermediate transfer belt 306. The toner images are not transferred to the recording paper 309 but remain as a non-transfer toner 374.

As shown in FIG. 2, in the full-color printer, in case the recording paper 309 to be fed is not fed to the secondary transfer position T2 due to jam, the toner images of the colors of yellow (Y), magenta (M), cyan (C), and black (K) transferred on the intermediate transfer belt 306 may remain on the recording paper 309 as the non-transfer toner 374.

As shown in FIG. 4, in the full-color printer, since the transfer residual toners 371 to 373 or the non-transfer toner 374 having a wide distribution of the amount of toner or the electrified amount of toner remain on the intermediate transfer belt 306, the transfer residual toners 371 to 373 or the non-transfer toner 374 are cleaned by the cleaning device 340 for the intermediate transfer belt as shown in FIGS. 1 and 2.

Figure 5:
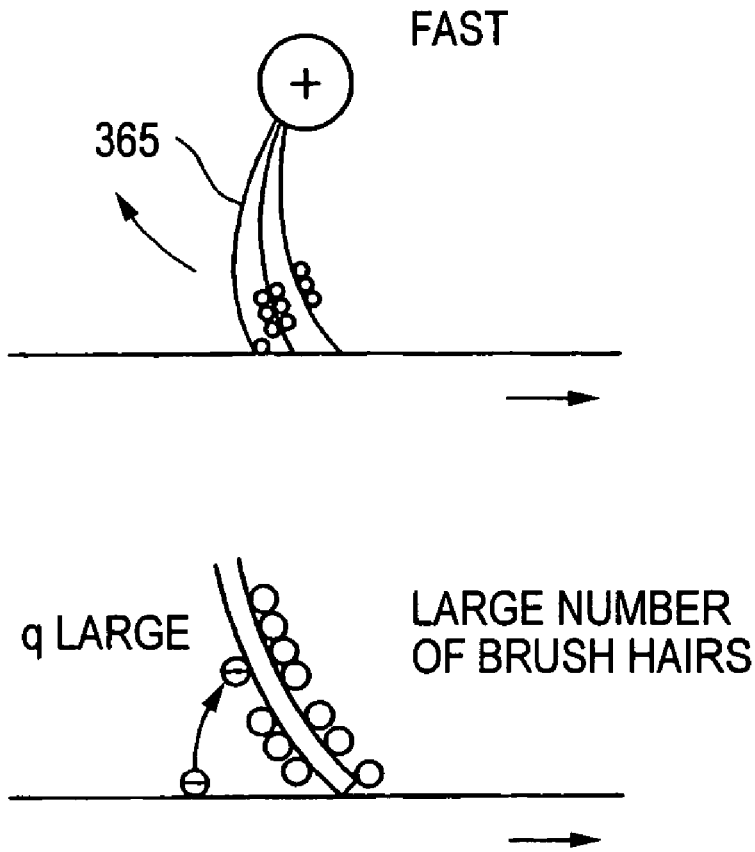
FIG. 5 is a view showing operation of a cleaning device according to the first embodiment.

As shown in FIG. 1, the cleaning device 340 for the intermediate transfer belt includes the first and second brush rolls 341 and 342. Among the transfer residual toners 371 to 373 or the non-transfer toner 374 that remain on the intermediate transfer belt 306, a large amount of non-transfer toner 374, which is electrified with a normal polarity, or a small amount of non-transfer toner 374, which is electrified with a normal polarity, are provided on an upstream of the movement direction of the intermediate transfer belt 306, and as described in FIG. 5, are absorbed to the brush fiber 343 of the first brush roll 341 by the high-speed rotating first brush roll 341 to which a positive bias voltage is applied, and are rotated at a high speed, and collected and removed by the next brush fiber 343.

Accordingly, in the first brush roll 341, the negative-polarity non-transfer toner 374 or transfer residual toner 373, which is electrified with a normal polarity, is absorbed to the brush fiber 343 by a coulomb force $F \propto q/r$ (r denotes a distance between a toner particle and the brush fiber 343) due to a difference with the amount of charge q of the brush fiber 343. In addition, since the first brush roll 341 rotates at a high speed, the number of brush fibers 343 contacting the surface of the intermediate transfer belt 306 per unit times is large, thereby completely removing the toner by the brush fibers 343.

In addition, since the first brush roll 341 rotates at a high speed, a large sliding friction acts on the non-transfer toner 374 or the toner residual toner 373 remaining on the intermediate transfer belt 306. Thus, it is possible to efficiently remove the non-transfer toner 374 or the transfer residual toner 373 remaining on the intermediate transfer belt 306.

In addition, since the negative-polarity non-transfer toner 374 or transfer residual toner 373, which is electrified with the normal polarity, is not strongly attached to the intermediate transfer belt 306, it is possible to securely remove the toner by the first brush roll 341 rotating in a high speed.

On the other hand, the transfer residual toner 371, which is electrified with a positive polarity opposite to the normal polarity and remains on the intermediate transfer belt 306, or the transfer residual toner 372, which has almost no electrified charge, flows into the first brush roll 341, and the transfer residual toner 371, which is electrified with a positive polarity opposite to the normal polarity, or the transfer residual toner 372, which has almost no electrified charge, is partly removed due to the sliding friction of the first brush roll 341 but mostly remains on the intermediate transfer belt 306.

Among the transfer residual toner 371 electrified with the positive polarity opposite to the normal polarity or the transfer residual toner 372 having almost no electrified charge, a toner passing through the first brush roll 341 reaches the second brush roll 342 provided on a downstream.

As shown in FIG. 1, since a negative bias voltage is applied to the second brush roll 342, the transfer residual toner 371 electrified with a positive polarity opposite to the normal polarity, among the transfer residual toner 371 electrified with a positive polarity opposite to the normal polarity or the transfer residual toner 372 having almost no electrified charge, is absorbed and removed by the second brush roll 342.

Figure 6:
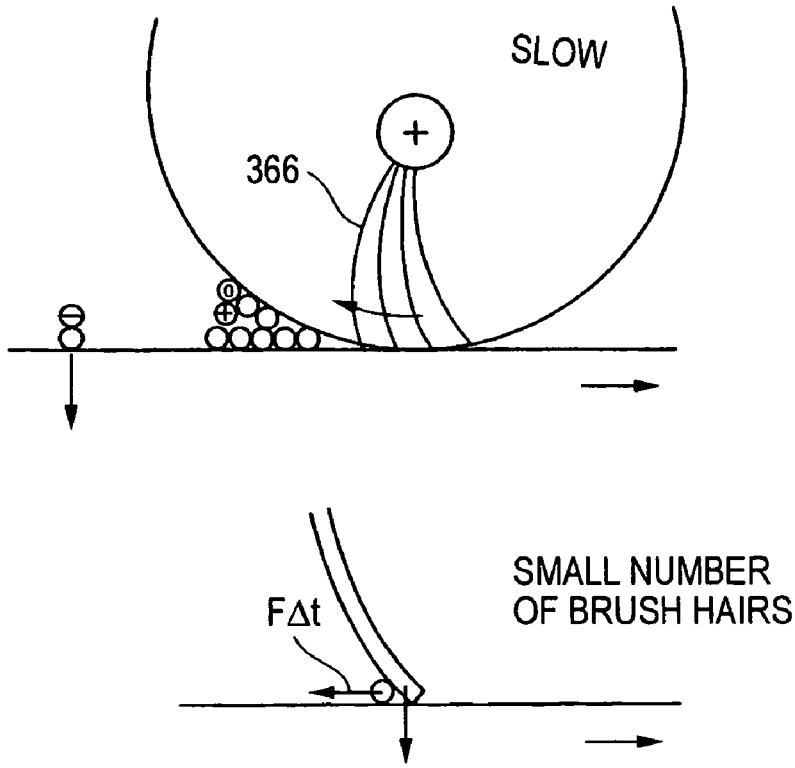
FIG. 6 is a view showing operation of a cleaning device according to the first embodiment.

As shown in FIG. 6, since the second brush roll 342 rotates in a low speed, a time $\Delta t$ in which an elastic force F of a single brush fiber 346 is applied to toner attached on a surface of the intermediate transfer belt 306 is longer than the first brush roll 341, and a mechanical impulse $F\Delta t$ the brush fiber 346 affects the transfer residual toner 372 is large. It is possible to block the transfer residual toner 372 having almost no electric charge on the intermediate transfer belt 306 and remove the toner by a mechanical sliding friction produced when a plurality of brush fibers 346 is contact with the surface of the intermediate transfer belt 306 in a blade shape.

In addition, since the second brush roll 342 rotates at a low speed, unlike a typical cleaning blade, a new brush fiber 346 slowly is contact with the surface of the intermediate transfer belt 306, and the toner removed by the brush fiber 346 is collected and, at the same time, a cleaning operation is performed with a new brush fiber 346.

Thus, it is possible to securely remove the transfer residual toner 371 electrified with the positive polarity opposite to the normal polarity or the transfer residual toner 372 having almost no electrified charge by the second brush roll 342.

In the above-mentioned full-color printer equipped with the cleaning device according to the first embodiment, as shown in FIG. 4, it is possible to collect the toners 371, 373, and 374 having a wide electrification distribution across both of the positive and negative polarities by electrostatic force by applying biases having different polarities with each other to the first and second brush rolls 341 and 342. At the same time, it is possible to electrify a development toner to have an opposite polarity by lowering the circulating speed of the surface of the second brush roll 342 applying a bias having the same polarity (for example, negative polarity), and to collect the toner (positive polarity) 371 having increased adhesive force by electric field. In addition, it is possible to mechanically block the toner, which is difficult to be collected by electrostatic force like the toner having an increased adhesive force due to a wide electrification distribution, or the toner 372 having almost no electric charge due to discharge, by slowly rotating the second brush roll 341 in a direction opposite to the movement direction of the intermediate transfer belt 306. Thus, it is possible to block the toner by forming a toner dam at an inlet of a brush nip. In addition, by slowly rotating the brush in a direction opposite to the movement direction of the intermediate transfer belt 306, it is possible to prevent washout due to an extreme increase of the toner dam by slowly collecting the toner dam. At the same time, it is possible to maintain the cleaning performance by preventing the toner from being accumulated on the surface of the brush 342.

In addition, it is possible to increase a mechanical scraping force with respect to the toner, which is electrified with the same polarity (negative polarity) as the non-transfer toner 374 and is large in quantity among the toner distribution, by make relatively higher the circulating speed of the surface of the first brush roll 341 applying a bias (for example, positive polarity) opposite to that of the development toner electrified with the normal polarity, thereby efficiently performing a cleaning operation. In addition, it is possible to weaken an adhesive force between the intermediate transfer belt 306 and the toner 374, to increase a ratio of collecting a large amount of toner 374, and to reduce a load of another second brush roll 342. In the first brush roll 341 having an increased mechanical scraping force, there is an effect of spreading by mechanically collecting or reducing an adhesive force with respect to the toner having the same polarity as a bias applied to generate an electrostatic force.

It is preferable that the first brush roll 341, to which a positive bias voltage is applied, is driven at a high speed, and the second brush roll 342, to which a negative bias voltage is applied, is driven at a low speed. A detailed description for them will be given.

As described above, while it is possible to efficiently collect the toner, which is difficult to be collected by an electrostatic force, by the second brush roll 342 rotating at a low speed, the brush roll 342 rotating at a low speed can collect a small amount of toner. In addition, when more than a predetermined amount of toner flows into the brush roll 342, the flowing toner exceeds the nip force of the brush roll 342 and the brush of the brush roll 342 is lifted up, such that the toner may not be completely cleaned.

Accordingly, since the amount of toner having a negative polarity is large and the amount of toner having a positive polarity is small, it is possible to securely collect the small amount of positive toner by electrostatic force and to block the toner, which is difficult to be collected by electrostatic force and has almost no electric charge, by a mechanical blocking force without washout of the toner dam by slowly rotating the second brush roll 342 to which a negative bias voltage is applied. In addition, even though a large amount of toner flows into the second brush roll 342 to which a negative bias voltage is applied, it is possible to securely clean the toner since the positive toner easily collected by the negative brush 342 by electrostatic force, and most of the toner flowing in the cleaning device 340 is a negative toner which is collected by a positive brush 341 included in the cleaning device 340. Most of the toner to be cleaned is the negative toner, and most of the negative toner is relatively less increased in toner charge. It is possible to securely collect the toner, which is large in amount and is not high in adhesive force, by increasing the collecting speed of the brush roll 341 to which a positive bias voltage is applied to increase the number of brush fibers 345 contacting a single toner. In addition, it is possible to collect the toner, which is extremely increased in electrified amount by discharge among the negative toner, by a mechanical blocking force by the low-speed brush roll 342 to which the negative bias voltage is applied. In addition, even though the polarities of the brush and the toner are the same, it is possible to collect the toner by the mechanical adhesive force of the brush if the amount of toner is small.

In the present embodiment, since it is possible to clean the toner for control produced at the timing between papers or immediately before forming an image without a brush condition such as the circulating speed of the brush, the present invention can be applied to an image forming apparatus having a high print speed without reducing the productivity.

Second Embodiment

Figure 7:
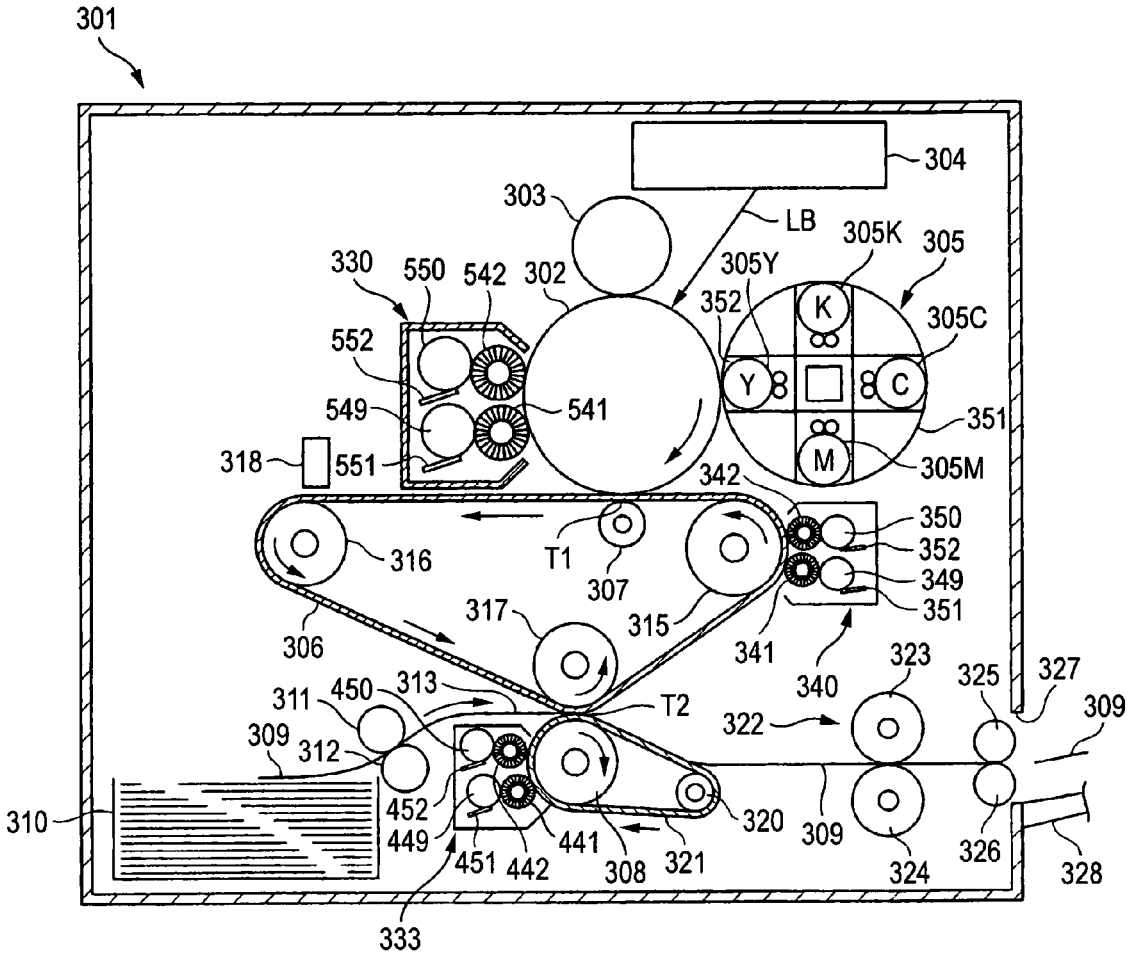
FIG. 7 is a perspective view showing a full-color printer serving as an image forming apparatus equipped with a cleaning device according to a second embodiment of the present invention.

FIG. 7 shows a second embodiment according to the present invention. The same parts as those of the first embodiment are denoted by the same reference numerals. In the second embodiment, the image carrier is a photosensitive drum.

That is, in the second embodiment, as shown in FIG. 7, a cleaning device 330 for a photosensitive drum has the same configuration as the cleaning drum 340 of the first embodiment.

Figure 8:
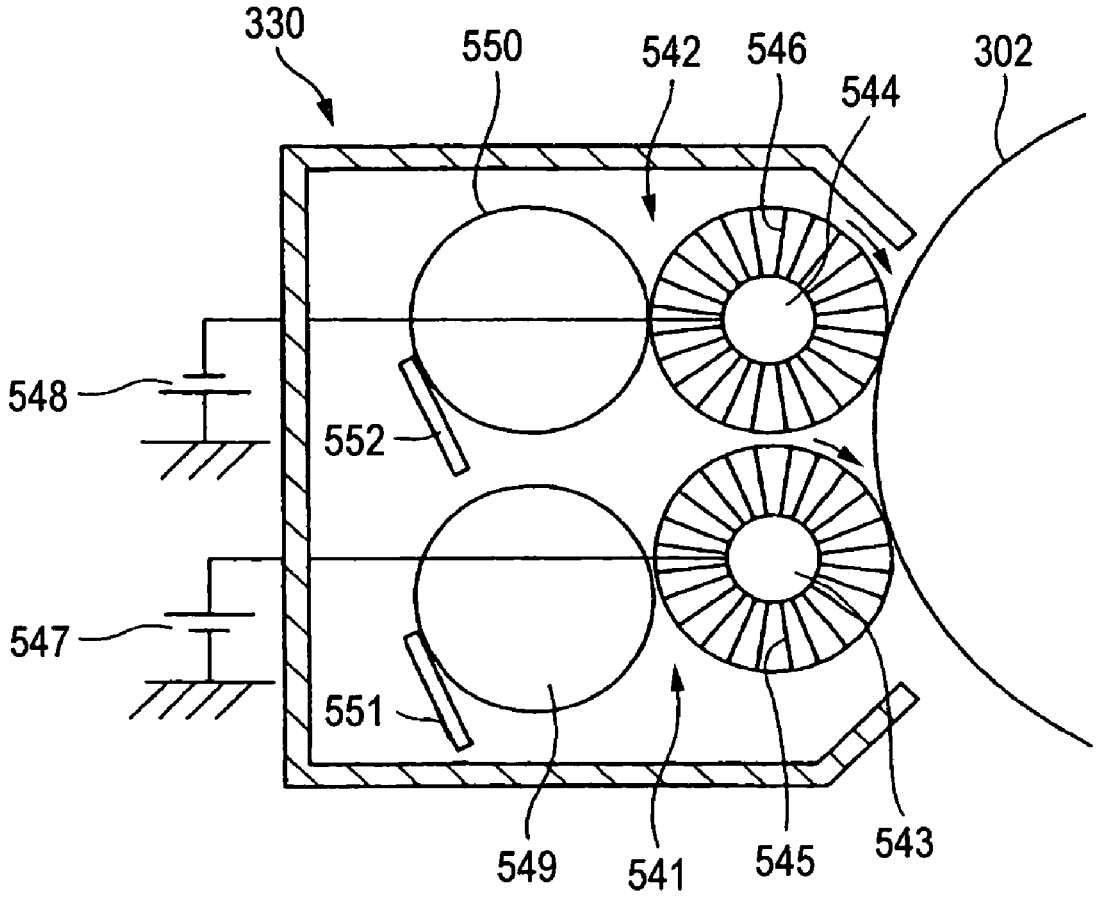
FIG. 8 is a schematic view showing a main part of a cleaning device according to the second embodiment.

As shown in FIG. 8, the cleaning device 330 for the photosensitive drum includes a first brush roll 541, a second brush roll 542, a collecting roll 549, a collecting roll 550, a cleaning blade 551, and a cleaning blade 552.

Since the cleaning device 330 of the photosensitive drum cleans a monochrome toner formed on the photosensitive drum 302, at least one of the brush density and the thickness of brush fiber of the first brush roll 541 and the second brush roll 542 is set to be smaller than that of the first embodiment.

Thus, since the first brush roll 541 and the second brush roll 542 impose less stress on the photosensitive drum 302, the photosensitive drum 302 has a longer life span.

Also, in the second embodiment, as shown in FIG. 7, a cleaning device 333 for a second transfer roll has the same configuration as the cleaning device 340 of the first embodiment. As shown in FIG. 7, the cleaning device 333 for the second transfer roll includes a first brush roll 441, a second brush roll 442, a collecting roll 449, a collecting roll 450, a cleaning blade 451, and a cleaning blade 452.

Other configuration and operation are the same as in the first embodiment and a detailed description for them will thus be omitted herein.

According to the embodiments, the plurality brush rolls may be formed of a conductive brush and rotate in the opposite direction to a movement of the image carrier.

According to the embodiments, it is possible to collect a toner having a wide electrification distribution over positive and negative polarities by electrostatic force since biases having different polarities are applied to a plurality of brush rolls, and it is possible to collect a toner (positive polarity) electrified with an opposite polarity due to discharge and having an increased adhesive force by electrostatic force because the circulating speed of the surface of the brush roll, in which a bias having the same polarity as that of a development toner is applied, is reduced. In case of a toner which is difficult to be collected by electrostatic force like a toner having an increased adhesive force due to a wide electrification distribution or a toner having few electric charge due to discharge, it is possible to block the toner by rotating the brush roll at a low speed in the opposite direction to a movement of the image carrier. In addition, it is possible to block the toner by forming a toner dam at an inlet of a brush nip. In addition, by rotating the brush in a direction opposite to the movement direction of the image carrier, it is possible to slowly collect the formed toner dam to prevent washout caused by an extreme increase of the toner dam and to prevent the toner from being accumulated on a surface of the brush, thereby maintaining the cleaning performance.

In addition, by making relatively high a circulating speed of a surface of the brush roll to which a bias having a polarity (for example, positive polarity) opposite to a development toner electrified with a normal polarity is applied, it is possible to increase a mechanical scraping force for a toner having the same normal polarity (negative polarity) as that of a large amount of non-transfer toner, and to effectively clean the toner. In addition, it is possible to weaken an adhesive force between the image carrier and the toner, and to reduce a load imposed on other brush rolls since the collecting ratio of a large amount of toner is increased. In addition, in case of the brush roll having an increase mechanical scraping force, there is an effect of collecting the toner mechanically or spreading the toner by reducing the adhesive force with respect to the toner having the same polarity as that of the bias applied to generate electrostatic force.

According to the embodiments, the brush roll, in which a positive bias voltage may be applied, is driven in a high speed, and a second brush roll, in which a negative bias voltage is applied, is driven in a low speed. A detailed description thereof will be given.

It is possible to efficiently collect a toner, which is difficult to be collected by electrostatic force, by a brush roll rotating in a low speed. However, the low-speed brush roll can collect a small amount of toner. In addition, when more than a predetermined amount of a toner flows in the brush roll, the force of the toner flowing into the brush roll exceeds the nip force of the brush roll. Thus, the brush of the brush roll is lifted up, resulting in poor cleaning performance.

Thus, considering the distribution of the amount of toner to be cleaned, the amount of toner having a negative polarity which is a normal polarity is large and the amount of toner having an opposite polarity is small. Accordingly, by rotating the brush roll, in which a bias voltage having a negative polarity is applied, in a low speed, it is possible to securely collect a small amount of positive toner by electrostatic force, and, at the same time, it is possible to mechanically block a toner having almost no electric charge, which is difficult to be collected by electrostatic force, without washout of a toner dam. In addition, when a large amount of toner flows into the brush roll to which a negative bias voltage is applied, a toner having a positive polarity is collected by a brush having a negative polarity, and a large amount of toner having a negative polarity flows into and is collected by a brush having a positive polarity provided in the cleaning device. Among the amount of toner to be cleaned, a large amount of toner has a negative polarity, these toners are not increased in the charge amount of toner. The toner can be securely collected by electrostatic force since the number of brushes contacting a single toner is increased by making high the rotating speed of the brush roll to which a positive bias voltage is applied. In addition, a toner having an extremely increased amount of charge by discharge among toner having a negative polarity can be collected by the mechanical blocking force by a low-speed brush roll to which the above-mentioned negative bias voltage is applied. Even though the brush and the toner have the same polarity, it is possible to collect the toner by the adhesive force of the brush if the amount of the toner is small.

According to the embodiments, it is possible to clean a toner for control produced immediately before the timing between papers or forming an image without changing a brush condition such as the circulating speed of brush. Accordingly, the present invention can be applied to an image forming apparatus having a high printing speed without reducing the productivity.

According to the embodiment, the cleaning device may include a first brush roll and a second brush roll which are sequentially formed from an upstream side along the movement direction of the image carrier, in which a bias having a polarity opposite to the normal polarity of the toner is applied to the first brush roll, and a bias having the same polarity as the normal polarity of the toner is applied to the second brush roll.

According to the embodiments, since a residual amount of the toner passing through the first brush roll rotating at a high speed having a positive polarity is small and an adhesive force between the toner and the image carrier is weak, it is possible to securely perform a cleaning operation by the second brush roll which is slow in surface circulating speed.

According to the embodiments, the image carrier may be a photosensitive drum.

In particular, since the cleaning toner of the photosensitive drum has a monochrome image, the distribution of the amount of toner in a typical image forming process is not so wide. However, since there is a retransfer toner, the distribution of toner polarity is wide.

Accordingly, the above-mentioned cleaning device can securely clean the toner, which is difficult to be collected by electrostatic force, such as toner having a large electrified charge and a high adhesive force, or toner having almost no electric charge. In addition, even though a developing agent is deteriorated due to environment or time elapse, and the amount of transfer residual toner is increased, the cleaning device can securely clean the toner. In addition, a large amount of toner which is not transferred when a paper is jammed can be collected without changing the setup.

On the other hand, since according to the related art, the brush method cannot deal with the distribution of the amount of toner or the electrified amount of toner, it is not possible to prevent toner discharged from the cleaning device or additives from contaminating an electrifying unit.

According to the embodiments, by providing a low-speed brush roll having a negative polarity on a downstream side, it is possible to securely block a toner, which is difficult to be collected, or a minute additive by forming a toner dam. Even though the toner or additive passes through the toner dam, the negative toner is not attached to the electrifying unit, and is developed and collected by a developer located on a downstream side.

In a blade method according the related arts, since a nip pressure required for cleaning is applied, the photosensitive drum is subject to be abraded. In particular, in the photosensitive drum, since the intermediate transfer belt is made of polycarbonate, which is easily abraded compared to resin such as polyimide, and is uniformly electrified, it is easily abraded since an electrifying unit by AC bias is frequently used.

The brush cleaning method according to the related arts has less stress than the blade cleaning method. However, part of the brush has large edge force due to unevenness in diameter of the brush, causing the surface of the photosensitive drum to be abraded. The abraded particles are attached to other part, causing the toner to be fixed to the surface of the photosensitive drum, i.e. a filming As a solution to this problem, the diameter of brush fiber is made small or the bite amount of the brush is made decreased to reduce the edge force of the brush. As a result, the cleaning performance of the cleaning device is reduced.

According to the embodiments, it is possible to securely perform a cleaning operation with respect to the wide distribution of toner, and to provide a better cleaning performance for the photosensitive drum. Accordingly, even though the edge force of the brush is lowered, the above-mentioned problems can be prevented.

According to the embodiments, the image carrier may be an intermediate transfer unit.

Since a multi-colored toner image is formed on the intermediate transfer unit, the amount of toner to be cleaned is large. Also, since a large amount of toner is transferred to a paper, a transfer bias is set to be high, and the toner is affected by strong discharge. Because of the discharge, the charge of the toner is shifted in an opposite direction from zero. The toner charge is easily evaded more easily on the surface of the conductive intermediate transfer unit than on the surface of the photosensitive drum having insulating property. When the toner is transferred to a water-containing paper, it is more distinguished. In addition, a large amount of toner remains on the intermediate transfer unit in paper jam is large because the toner has a plurality of colors. In addition, the toner remaining on the photosensitive drum in paper jam is transferred to the intermediate transfer unit when the paper is jammed and is cleaned on the intermediate transfer unit to reduce load applied to the cleaning device for the photosensitive drum since it is not possible to secure a sufficient cleaning pressure in the photosensitive drum which is easily abraded. In addition, the toner image for control formed on the non-image part of the intermediate transfer unit is mostly transferred on the intermediate transfer unit and is cleaned since a space required for providing a sensor detecting the toner image is relatively large.

According to the embodiments, it is possible to securely clean the toner having a wide distribution of the amount of toner and the toner charge.

In addition, since it is possible to clean the toner for control formed on the intermediate transfer unit at the timing between papers or immediately before forming the image without changing a brush condition such as the circulating speed of the brush, the present invention can be applied to an image forming apparatus having a high print speed without reducing the productivity. In addition, since it is possible to securely clean the toner for control on the intermediate transfer unit, it is possible to frequently form and detect the toner for control and to improve the image quality of the image forming apparatus and the accuracy of registration.

According to the embodiments, it is possible to provide a cleaning device that securely removes a toner having a wide distribution of the amount of toner or the electrified amount of toner without a complex structure of a driver or to make the size of the driver large, and is applied to a high-speed image forming apparatus, and an image forming apparatus having the same.

Third Embodiment

Figure 10:
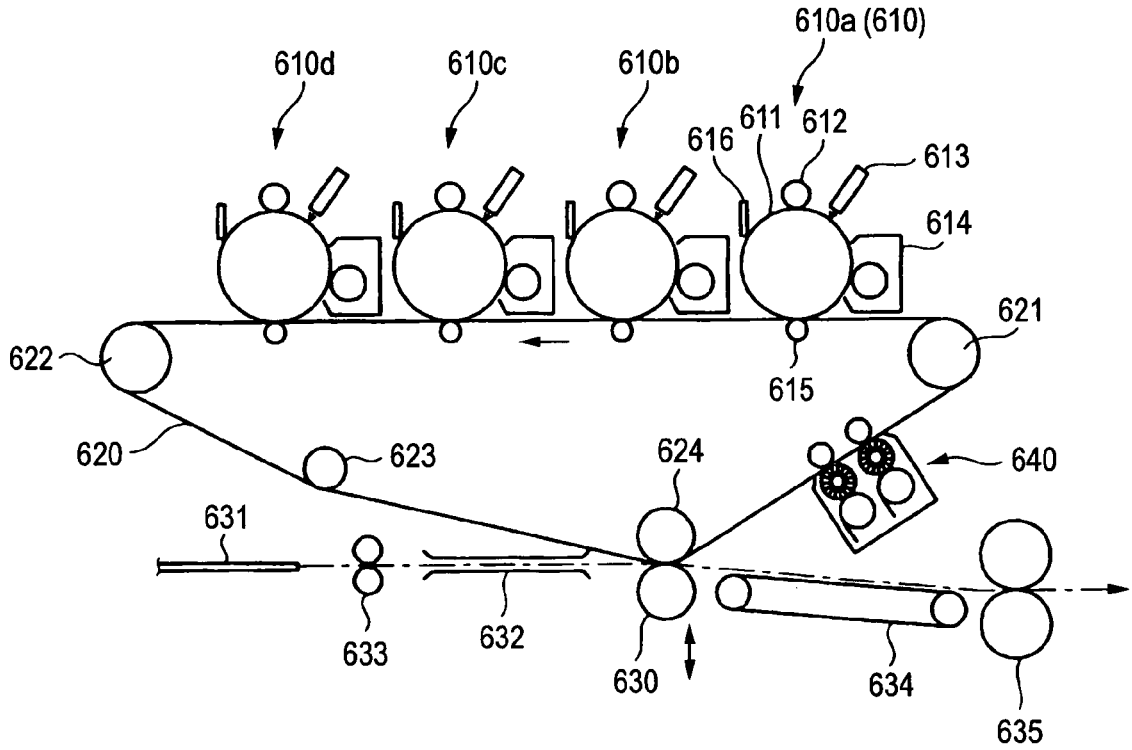
FIG. 10 is a diagram schematically showing an image forming apparatus according to a third embodiment.

FIG. 10 is a schematic view showing an image forming apparatus according to third embodiment to which a cleaning device is applied In FIG. 10, the image forming apparatus according to the third embodiment includes electrophotographic image forming units 610 (610*a* to 610*b*) forming four colors (in the third embodiment, yellow, magenta, cyan, and black) of color component toners and an intermediate transfer belt 620 by which color component toner images formed by the respective image forming units 610 are sequentially transferred (primary transfer) so as to be conveyed while being held.

Each of the image forming units 610 (610*a* to 610*d*) has a photoconductor drum 611 by which an electrostatic latent image is held. Around the photoconductor drum 611, there are respectively arranged an electrifying device 612 such as an electrifying roller which electrifies the photoconductor drum 611, an exposing device 613 such as a laser scanner which writes an electrostatic latent image onto the electrified photoconductor drum 611, a developing device 614 which develops the electrostatic latent image written onto the photoconductor drum 611 by using the respective color component toners, a primary transfer device 615 such as a transfer roller which transfers the toner image on the photoconductor drum 611 onto the intermediate transfer belt 620, and a drum cleaner 616 which removes the residual toner on the photoconductor drum 611. The primary transfer device 615 is disposed so as to oppose the photoconductor drum 611 with the intermediate transfer belt 620 interposed therebetween.

The intermediate transfer belt 620 is formed of a film-shaped endless belt of which the volume resistivity is adjusted by kneading conductive carbon black into polyimide resin, for example. The intermediate transfer belt 620, which is stretched by four stretch rollers 621 to 624, cycles in the arrow direction of FIG. 2, with the stretch roller 621 being set to a driving roller and with the stretch roller 622 being set to a tension roller.

In the present embodiment, the intermediate transfer belt 620 is formed of polyimide resin. Without being limited thereto, another forming material such as polyester resin or a rubber material such as chloroprene rubber may be used.

In the position opposite to the stretch roller 624, a secondary transfer device 630 such as a transfer roller, which collectively transfers the superimposed toner image on the intermediate transfer belt 620 onto a recording material 631, is provided to be retractable with respect to the intermediate belt 620 so that a transfer bias (not shown) is applied, with the stretch roller 624 being set to a backup roller.

In the upstream side of the secondary transfer device 630 in the direction where the recording material is conveyed, there is provided a conveying guide 632 guiding the recording material 631 up to a secondary transfer portion. In the upstream side of the conveying guide 632, there is provided a resist roller 633 by which the recording material is positioned and conveyed.

On the other hand, in the downstream side of the secondary transfer device 630, a conveying device 634 is provided to convey the recording medium 631 onto which the toner image 631 is collectively transferred. Further, in the downstream side of the conveying device 634, a fixing device 635 is provided to fix the toner image on the recording material 631.

According to the third embodiment, a cleaning device 640 is arranged between two adjacent stretch rollers 621 and 624 of the intermediate transfer belt 620.

Figure 11:
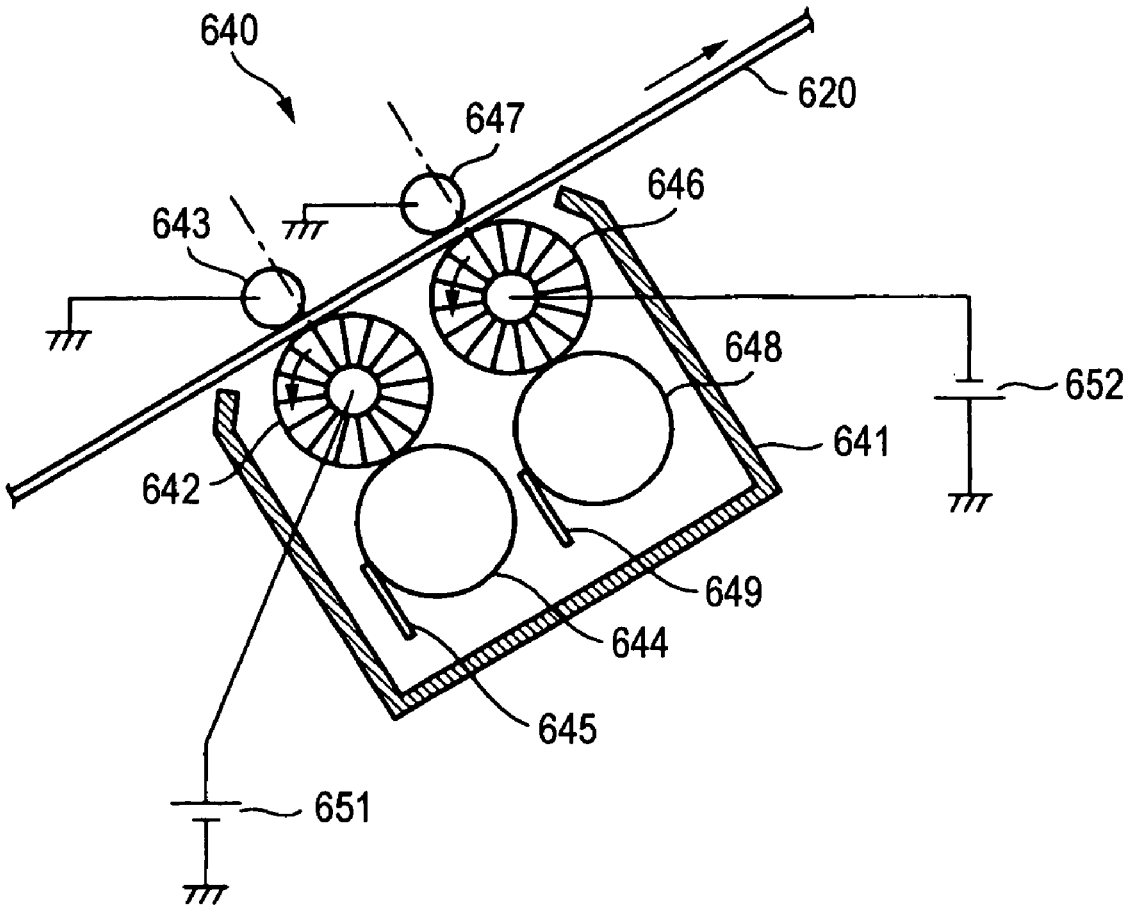
FIG. 11 is a diagram showing a cleaning device of the third embodiment.

In the cleaning device 640 of the present embodiment, as shown in FIG. 11, two rotating brushes 642 and 646 are disposed inside a cleaning case 641 so as to be abutted on the intermediate transfer roller 620 and to move in the reverse direction (against direction) to the moving direction of the intermediate transfer belt 620. Further, two of the rotating brushes are opposed to each other in the moving direction of the intermediate transfer roller 620.

In the positions which are respectively opposite to the rotating brushes 642 and 646 with the intermediate transfer belt 620 interposed therebetween, conductive counter rollers 643 and 647 are disposed to be slightly biased with respect to the respective rotating brushes 642 and 646 (disposed in the upstream side of the intermediate transfer roller 620 in the moving direction thereof). The counter rollers 643 and 647 of the present embodiment are pressed toward the intermediate transfer roller 620 so as to form a contact region in a portion where the counter rollers are in contact with the intermediate transfer roller 620. Further, all the counter rollers 643 and 647 are grounded. As the counter rollers 643 and 647, an elastic roller or metal roller may be used without being particularly limited, if the elastic roller or metal roller has a conductivity and can form a contact width with the intermediate transfer roller 620. Furthermore, the counter roller 643 may be formed in a brush shape.

Behind the rotating brushes 642 and 646 within the cleaning case 641, collecting rollers 644 and 648 are provided to remove the toner adhered to the rotating brushes 642 and 646. The toner which is electrostatically collected from the rotating brushes 642 and 646 is scraped off by blades 645 and 649 which are disposed to be in contact with the collecting rollers 644 and 648.

In the third embodiment, the collecting rollers 644 and 648 are used to remove toner adhered to the rotating brushes 642 and 646. However, a flicker bar, for example, may be used to flick off toner adhered to the rotating brushes 642 and 646, and a vacuum may be used to suck up toner adhered to the rotating brushes 642 and 646.

Two of the rotating brushes 642 and 646 in the third embodiment are respectively connected to respective bias power supplies 651 and 652 so that cleaning biases whose polarities are different from each other are applied thereto. Further, in the present embodiment, a plus bias is applied to the upstream rotating brush 642 and a minus bias is applied to the downstream rotating brush 646. Without being particularly limited thereto, a plus bias may be applied to the downstream rotating brush 646 and a minus bias may be applied to the upstream rotating brush 646. Further, a direct electric field in which an alternate electric field is superimposed may be used instead of a direct current bias.

The feature point in the third embodiment is a contact state when the rotating brushes 642 and 646 and the counter rollers 643 and 647 respectively are in contact with the intermediate transfer belt 620.

Figure 12:
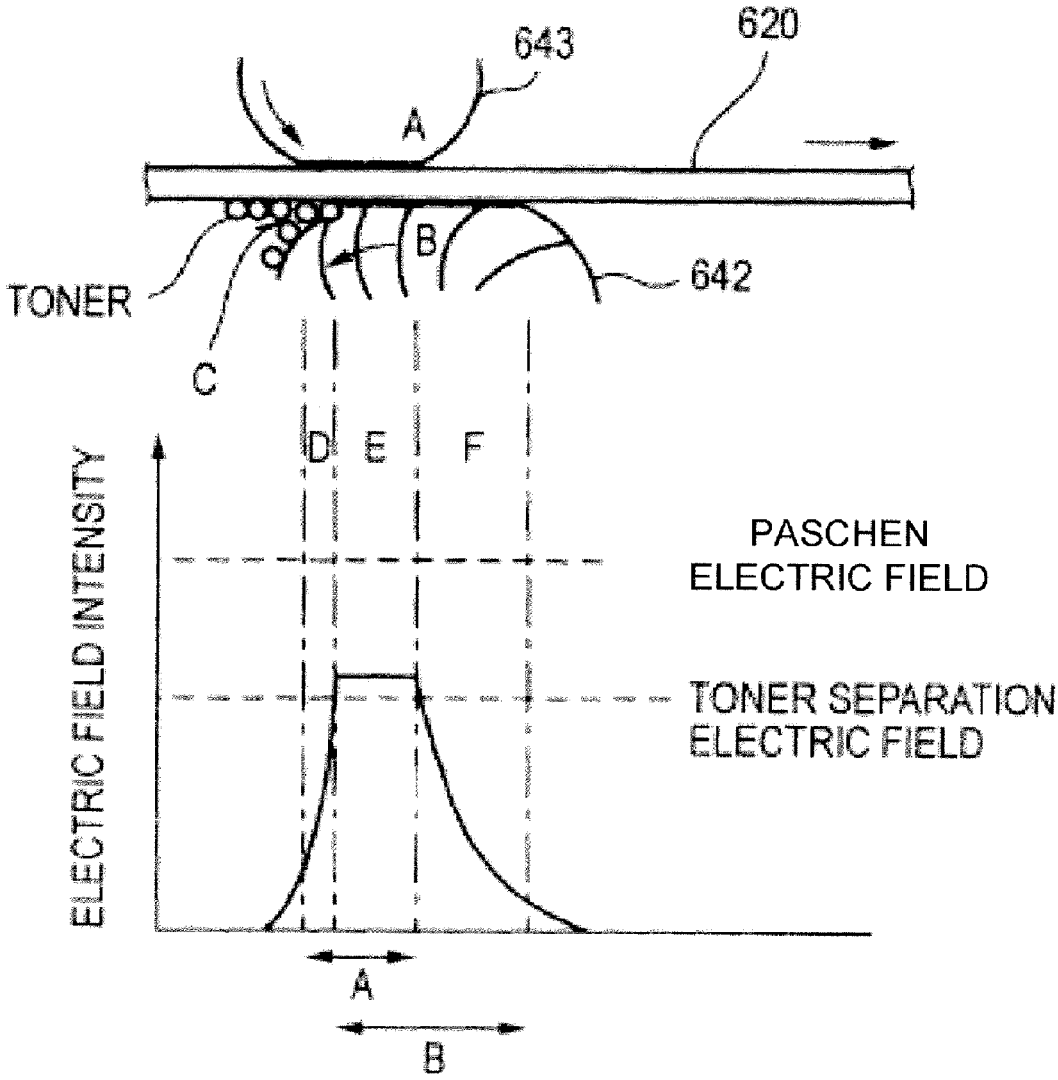
FIG. 12 is a diagram showing an action of a cleaning portion of the third embodiment.

In the present embodiment, the contact state, where the rotating brush 646 and the counter roller 643 (here, only the upstream rotating brush and counter roller are shown in order to simplify the description) are in contact with the intermediate transfer belt 620, is shown in the upper portion of FIG. 12.

In other words, the contact region of the counter roller 643 (region A corresponding to a contact width) is narrower than the contact region (region B) of the rotating brush 642, and a separation point (point C) where the rotating brush 642 separates toner from the intermediate transfer belt 620 is set to be within the range of the region A.

Therefore, the intensity of an electric field applied to the intermediate transfer belt 620 in the portion where both the counter roller and the rotating brush are opposed to each other is the greatest in a region where the regions A and B are overlapped with each other, and gradually decreases in the front and rear regions, as shown in the lower portion of FIG. 4. In other words, if a region where the region A is not overlapped with the region B is set to a region D, the region where the region A and region B are overlapped with each other is set to a region E, and a region where the region B is not overlapped with the region A is set to a region F, the electric field intensity gradually decreases in the regions D and F.

Next, an operation of an image forming apparatus according to the third embodiment will be described.

The following description is addressed to a separation point of the rotating brush 642.

As shown in FIG. 10, the color component toner images formed on the photoconductor drums 611 of the respective image forming units 610 (610*a* to 610*d*) are sequentially transferred onto the intermediate transfer roller 620 by the primary transfer device 615 so that a superimposed toner image is formed on the intermediate transfer belt 620. After that, the toner image held on the intermediate transfer belt 620 is caused to reach the installed portion of the secondary transfer device 630 by the cycling of the intermediate transfer belt 620.

In the secondary transfer portion of the secondary transfer device 630, the toner image on the intermediate transfer belt 620 is collectively transferred onto the recording material 631 of which the position is regulated by the resist roller 633.

The recording material 631 onto which the toner image is collectively transferred by the secondary transfer device 630 is guided to the fixing device 635 through a conveying device 684 so as to be fixed. After that, the recording material 631 is conveyed to a discharge tray (not shown) or the like.

In such an image forming apparatus, the operation of the cleaning device 640 will be described.

If the toner image is secondly transferred by the secondary transfer device 630, residual toner whose electrification distribution is wide remains on the intermediate transfer belt 620. This is because, since a relatively large transfer electric field is applied during the secondary transfer in order to transfer the superimposed toner image onto the recording material 631, the adhesion of the residual toner on the intermediate transfer belt 620 becomes large due to the discharge at the time of transfer.

In the third embodiment, as shown in FIG. 12, the electric field in the entire region E where the regions A and B are overlapped is less than the Paschen electric field, and a toner-separation electric field is sufficiently secured in the toner-separation point (the point C of FIG. 12) where toner is separated from the intermediate transfer belt 620 by the rotating brush 642. Further, since the region A is provided across the toner-separation point (the point C), a stable electric field in which an edge effect is suppressed is applied at the point C. At the separation point, the residual toner is easily adsorbed into the rotating brush 642 from the intermediate transfer belt 620 by the sliding friction force of the rotating brush 642.

In the third embodiment, as the counter roller 643 is made small, a cleaning bias can be focused as much at the separation point, and a miniaturized image forming apparatus can be implemented.

Figure 13A:
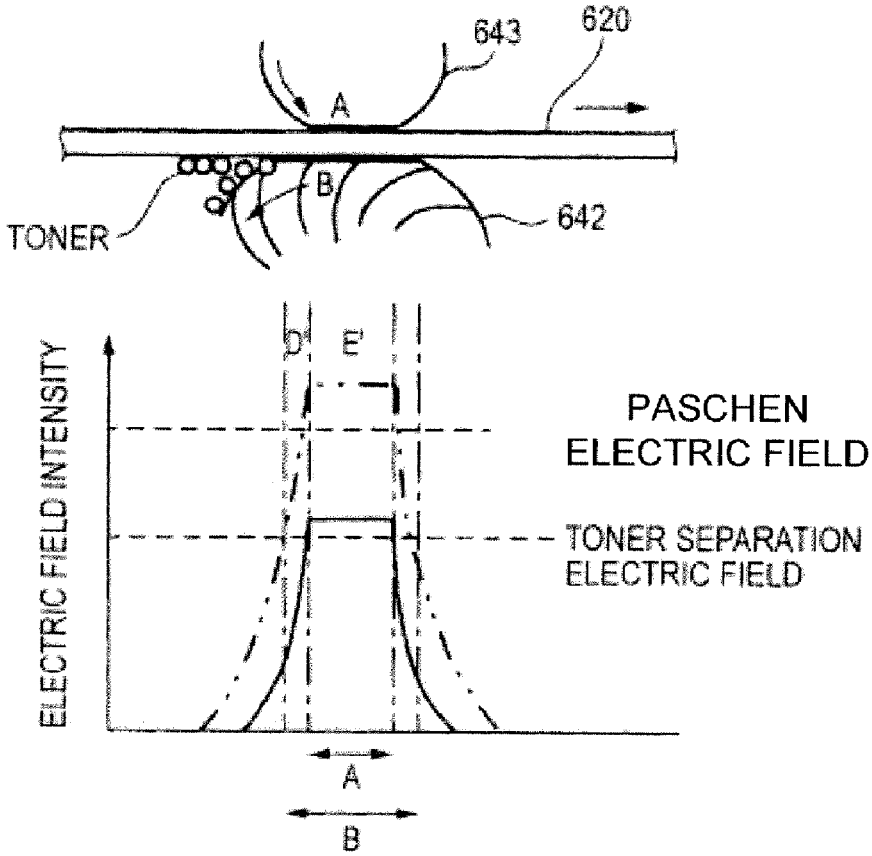
FIG. 13A is a diagram showing an action of the cleaning portion as a comparative example.

At this time, if the counter roller 643 is not disposed so as to be biased from the rotating brush 642 but is disposed in the center of the rotating brush 642, the boundary between an upstream region D' and downstream region E' does not correspond to a separation point, but the start position of the region D' corresponds to the separation point, as shown in FIG. 13A.

In this case, in order to apply a cleaning electric field effective with toner at the separation point, the bias applied between the rotating brush 642 and the counter roller 643 needs to be increased so as to raise an operational electric field at the separation point. However, if the cleaning bias is raised in such a manner, an electric field which is applied to both the rotating brush and the counter roller increases significantly, and the discharge exceeding the Paschen electric field is generated. As a result, the polarity of toner is inversed and the toner accumulated in the brush is discharged, thereby reducing the cleaning performance.

Figure 13B:
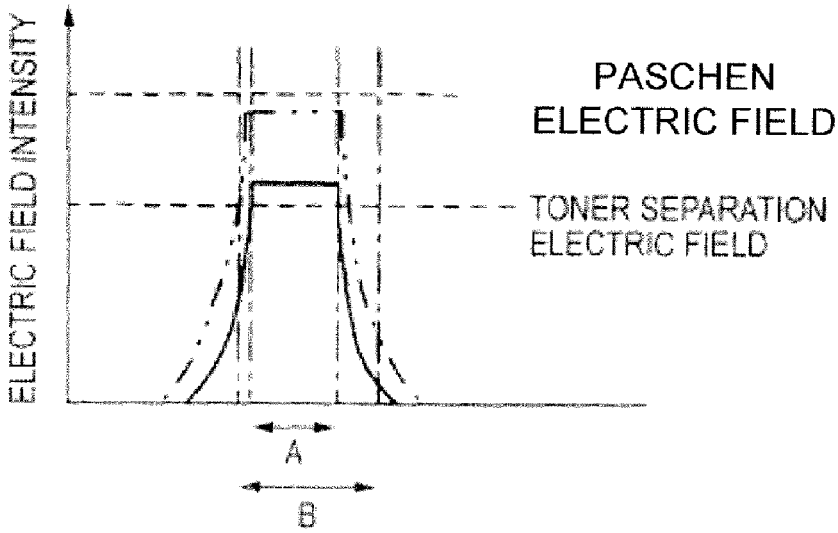
FIG. 13B is a diagram showing an action of a cleaning portion as a modified example of the third embodiment.

As shown in FIG. 13B, if the contact width (A) between the counter roller 643 and the intermediate transfer belt 620 is biased toward the separation point of the contact width (B) between the rotating brush 642 and the intermediate transfer belt 620, the separation electric field at the separation point can be secured without exceeding the Paschen electric field. Therefore, such an operation allows the residual toner to be adsorbed into the rotating brush 642.

In the third embodiment, the counter rollers 643 and 647 are disposed to be biased from the rotating brushes 642 and 646, as shown in FIG. 11. The contact width between each of the counter rollers 643 and 647 and the intermediate transfer belt 620 and the contact with each of the rotating brushes 642 and 646 and the intermediate transfer belt 620 are set as described above. Therefore, the performance of cleaning residual toner on the intermediate transfer belt 620 can be maintained to be excellent.

As shown in FIG. 10, the cleaning device 640 is provided in the intermediate transfer belt 620 between the stretch rollers 621 and 624. Therefore, the cleaning device 640 itself can be housed within the horizontally and vertically projected region of the intermediate transfer belt 620. Further, the space occupied by the intermediate transfer unit (including the intermediate transfer belt 620 and the image forming unit 610) can be effectively used, so that a small-sized image forming apparatus can be provided.

In other words, when the tandem intermediate transfer belt 620 is used, the intermediate transfer belt 620 has a cycling route of which the cross-sectional shape is long in one direction, so that the plurality of image forming units 610 are disposed on the same surface. Therefore, if the cleaning device is opposed to the stretch roller (for example, the stretch roller 621), the intermediate transfer unit is constructed so as to further extends in the long direction. On the other hand, in the substantially triangle cross-sectional shape where the backup roller (serves as the stretch roller 624) of the secondary transfer device 630 is disposed in the opposite side to the image forming units 610, the space is easily secured in the downstream side of the secondary transfer device 630, and the cleaning device 640 of the present embodiment is arranged in the space. Therefore, the image forming apparatus does not become unnecessarily large.

Although the counter rollers 643 and 647 are used in the third embodiment, a conductive member such as a metal plate or elastic pad may be disposed to be fixed to the rear side of the intermediate transfer belt 620 instead of the counter rollers 643 and 647. However, when such a conductive member is disposed to be fixed, at least the surface thereof is preferably provided with a lubricative layer so as to reduce the sliding friction force with the intermediate transfer belt 620, because the member always frictionally slides on the intermediate transfer belt 620. In addition, if such a conductive member is disposed to be fixed, it is apprehended that the surface of the intermediate transfer belt 630 is worn or damaged and abnormal noise is produced. Further, defective cleaning can be caused by toner or foreign matter adhered to the conductive member or the belt surface, and an image quality defect can occur when abrasion powder is transferred to the transfer device 615 or the backup roller 624 of the secondary transfer device 630 through the belt surface. Therefore, the counter rollers 643 and 647 are preferable, rather than the conductive member which is disposed to be fixed.

In the third embodiment, the rotating brushes 642 and 646 rotate in the against direction with respect to the moving direction of the intermediate transfer belt 620. Without being limited thereto, however, the rotating brushes 642 and 646 may rotate in a so-called with direction where the rotating brushes and the intermediate transfer belt move in the same direction in the opposed portion thereof.

Figure 14:
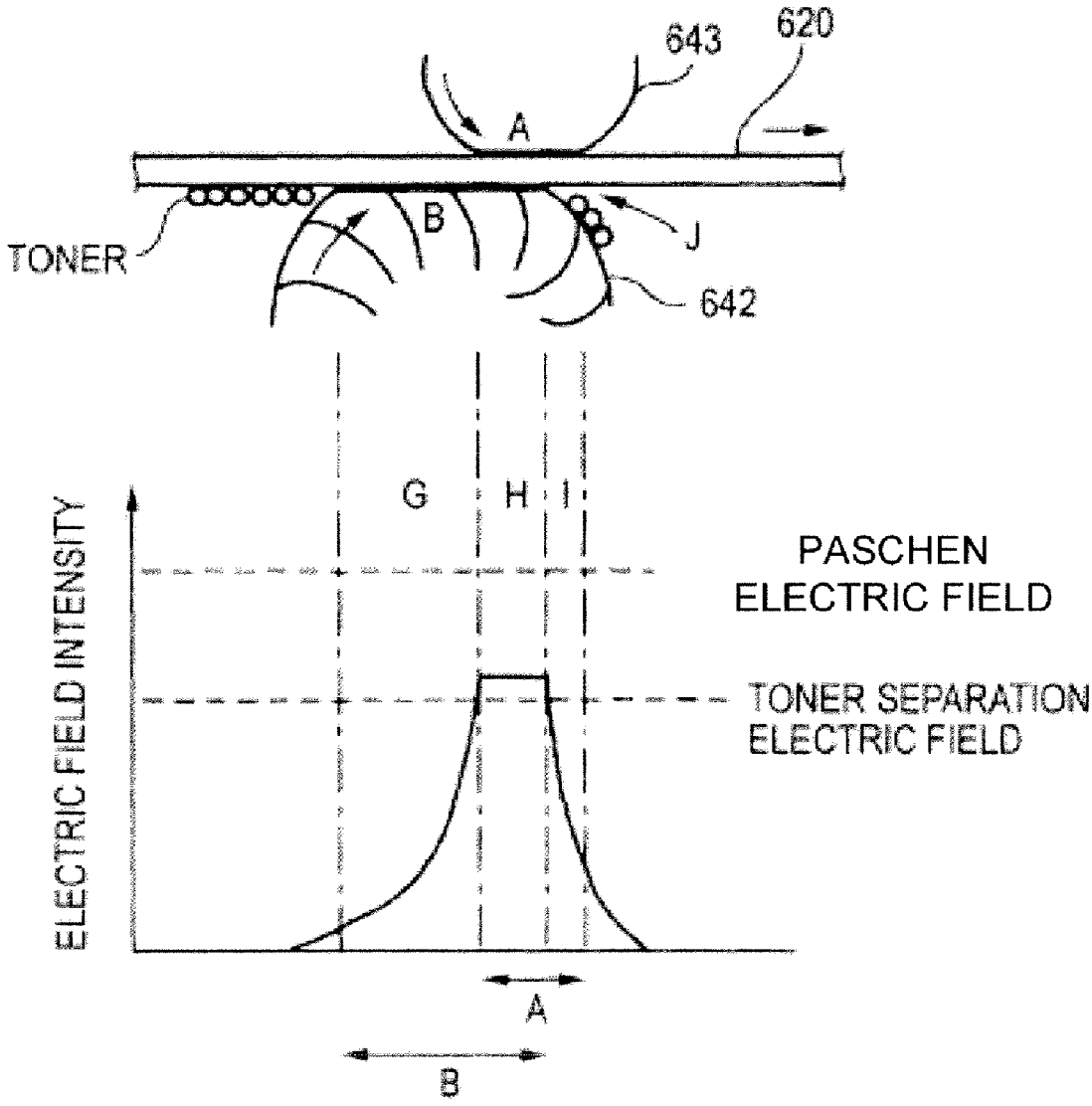
FIG. 14 is a diagram showing an action of a cleaning portion as another modified example of the third embodiment.

FIG. 14 is a diagram showing a manner in which the rotating brushes 642 and 646 rotate in the width direction, as a modified example of the third embodiment, showing the rotating brush 642 as a representative component.

A toner-separation point in this case is positioned at a point J which is the boundary between regions H and I.

In this case, the toner on the intermediate transfer belt 620 is sucked toward the rotating brush 642 in a region G, and an effective cleaning bias acts in the region H where the counter roller 643 and the rotating brush 642 commonly are in contact with the intermediate transfer belt 620. Further, while an effective cleaning bias acts on the point J where the brush of the rotating brush 642 separates toner from the intermediate transfer belt 620, toner is adsorbed into the rotating brush 642.

The toner adsorbed into the rotating brush 642 is collected from the rotating brush 642 by a collecting roller (not shown).

Therefore, although the rotating brush 642 is rotated in the with direction with respect to the intermediate transfer belt 620, the cleaning performance of the cleaning device 640 can be sufficiently maintained, with the counter roller 643 being disposed as shown in FIG. 6.

In the third embodiment, the rotation speed of the rotation brushes 642 and 646 is not changed. However, when it is determined that the residual toner on the intermediate transfer belt 620 has been secondly transferred by the secondary transfer device 630 (when it is determined that the secondary transfer process has passed), the rotation speed of the rotation brush 642 may be slowed down more than otherwise.

As such, slowing down the speed of the rotating brushes 642 and 646 when the secondary transfer is performed allows the cleaning of residual toner, whose electrification distribution is widen by the secondary transfer, to be improved.

In the third embodiment, two of the rotating brushes 642 and 646 are used, and the biases having a different polarity from each other are applied. However, a plate-shaped member (such as a blade or scraper) in which the application of bias has been performed may be provided in the upstream side, and the polarity of the residual toner passing through the plate-shaped member may be aligned so that the cleaning is performed by the single rotating brush 642.

In the third embodiment, the cleaning device 640 is applied to a so-called tandem image forming apparatus. The cleaning device may be used in a so-called cycle-type image forming apparatus which transfers the respective colors of toner images onto an intermediate transfer belt whenever the corresponding intermediate transfer belt rotates 360°. Further, in the present embodiment, the cleaning device 640 is used in the intermediate transfer belt 620. However, the cleaning device may be applied to a photoconductor belt or the like, if the photoconductor belt is a belt-shaped member.

Fourth Embodiment

Figure 15:
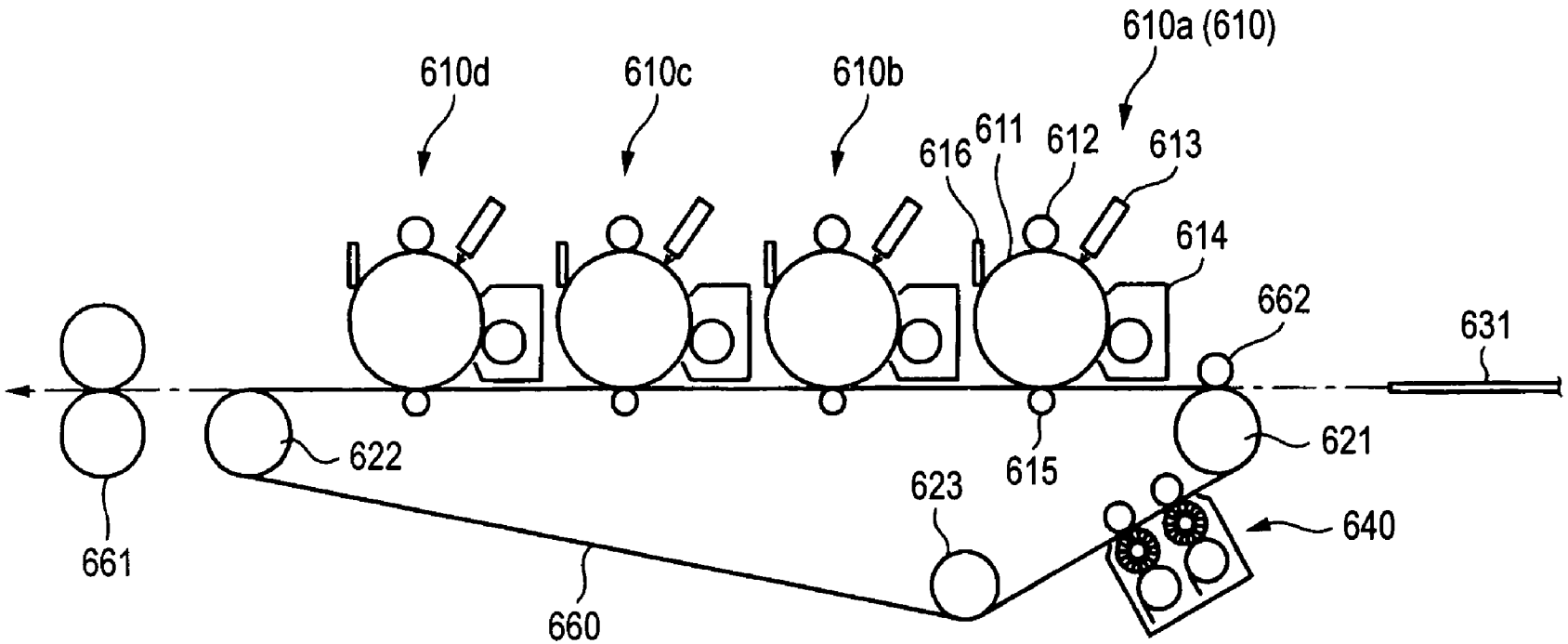
FIG. 15 is a diagram schematically showing an image forming apparatus according to a fourth embodiment.

FIG. 15 shows a cleaning device according to a fourth embodiment. The image forming apparatus of the fifth embodiment is different from the third embodiment in the following aspects. A recording material is conveyed by a recording material conveying belt, and respective colors of toner images are directly transferred onto the recording material. The same reference numerals are attached to the same components as the third embodiment, and the descriptions thereof will be omitted.

In the image forming apparatus of the fourth embodiment shown in FIG. 7, the recording material conveying belt 660 of which the volume resistivity is adjusted is stretched by three stretch rollers 621 to 623, and the stretch roller 21 is used as a driving roller so that the recording material conveying belt 660 cycles and conveys a recording material. On one surface of the recording material conveying belt 660, four image forming units 610 (610*a* to 610*d*) are disposed in a line.

In addition, an electrifying device 662 is provided in the position where the electrifying device 662 and the stretch roller 621 are opposed to each other with the recording conveying belt 660 interposed therebetween, and electrifying the surface of the recording material conveying belt 660 allows a recording material 631 to be adsorbed on the recording material conveying belt 660. Further, in the recording material conveying belt 660 between the stretch rollers 621 and 623, the cleaning device 640 is arranged.

In the fourth embodiment, in the downstream side of the stretch roller 622 in the moving direction of the recording material conveying belt 660, a fixing device 661 is provided to fix toner transferred onto the recording material 631.

Next, the operation of the image forming apparatus according to the fourth embodiment will be described.

The recording material 631 is adsorbed onto the recording material conveying belt 660 by an action of the electrifying device 662 so as to be conveyed to the image forming units 610. In the image forming units 610, respective colors of toner images formed on the photoconductor drum 611 are sequentially transferred onto the recording material 631 by the transfer device 615 (corresponding to the primary transfer device of the first embodiment), and a superimposed toner image is formed on the recording material 631 by four of the image forming units 610 (610*a* to 610*d*)

In the vicinity of the stretch roller 622, the recording material 631 is separated from the recording material conveying belt 660 by a separation nail (not shown), and the fixing is performed by the fixing device 661.

In such an image forming apparatus, toner can be adhered to the recording material conveying roller 660 due to a jam of the recording material 631. In this case, the toner is removed by the cleaning device 640 through the same action as the third embodiment so that the cleaning performance thereof is sufficiently maintained. In the fourth embodiment, the secondary transfer is not needed, different from the third embodiment. Therefore, the adhesion of toner which is adhered on the recording material conveying belt 660 is typically smaller than in the third embodiment.

According to the embodiment, the belt member 601 of the present application may be a belt-shaped member which is used in an image forming apparatus using toner, and may be any one of an intermediate transfer body, an image holding body (specifically, including a photoconductor body and dielectric body), and a recording material conveying body. In particular, the intermediate transfer body in which the electrostatic brush cleaning is relatively hard to be performed is preferable, because an amount of residual toner becomes large and the toner charge distribution becomes wide.

The combined number of rotating brushes 603 and counter members 604 is not limited in the embodiments. a pair or plural pairs may be provided.

The counter member 604 may have a conductivity so that a cleaning bias can be applied and may be fixed or rotate. Further, if the counter member 604 has the contact region with the belt member 601, it may be formed to stretch the belt member 601 or may be simply disposed to be in contact with the belt member 601. As the counter member 604, a rotating member (a roller member) is preferable in view of the reduction in the load onto the belt member 601.

According to the embodiments, when the respective contact positions of the rotating brush 603, the counter member 604, and the belt member 601 are set as described above, the cleaning electric field can effectively act, while the abnormal discharge by Paschen's law is suppressed at the separation point (which means the exit side in the rotation direction of the rotating brush 603 in the rotating brush contact region and which corresponds to a point C) where the toner (mainly consisting of residual toner) on the belt member 601 is separated by the rotating brush 603.

According to the embodiments, the counter member contact region (A) is preferably set to include at least the exit (the point C) of the rotation brush contact region (B) in the rotation direction of the rotating brush 603. Accordingly, the separation point is disposed to face the edge or inside of the counter member contact region (A), and an effective cleaning electric field can be caused to act, while the abnormal discharge at the separation point is further suppressed. If the counter member contact region (A) extends outside the separation point, an edge effect can be reduced, and a stabilized cleaning electric field can be caused to act.

According to the embodiments, the rotation direction of the rotating brush 603 is reverse (the against direction) to or the same (the with direction) as that of the belt member 601 in a portion where the rotating brush 603 and the belt member 601 face each other. However, in order that the rotating brush 603 further effectively separates toner from the belt member 601, the rotating brush may rotate in the reverse direction (the against direction) to the moving direction of the belt member 601.

When the plurality of rotating brushes 603 and counter members 604 are provided, the polarities of the cleaning biases applied between at least two pairs of rotating brushes 603 and counter members 604 may be set to different from each other. According to this, the cleaning performance can be secured even though wide electrification distribution is present in the toner on the belt member 601.

According to the embodiments, there is provided the driving control unit which switches the rotation speed of the rotating brush 603 according to whether the toner on the belt member 601 before cleaning has been transferred or not. The driving control unit may slow down the rotation speed when it is determined that the toner on the belt member 601 has been transferred, more than otherwise. According to this, the cleaning performance can be maintained, even though the electrification distribution of the residual toner on the belt member 601 after the transfer process is so wide that the toner is not electrostatically collected with ease.

According to the embodiments, the cleaning device may be disposed to be housed within the horizontally and vertically projected region of the belt member 601. According to this, the miniaturization of the image forming apparatus can be accomplished, and the degree of freedom of the design can be increased.

Without being limited to the cleaning device, the image forming apparatus provided with the image holding body in which an electrostatic latent image is held and the above-described cleaning device is also an object of the embodiments.

According to the embodiments, in the cleaning device in which the counter member and the rotating brush are provided to face each other with the belt member interposed therebetween and a cleaning bias is applied therebetween, the width of the counter member contact region, where the counter member is in contact with the belt member, in the belt member conveying direction is narrower than the width of the rotating brush contact region, where the rotating brush is in contact with the belt member, in the belt member conveying direction. Further, the counter member contact region is disposed to be biased toward the exit in the rotation direction of the rotating brush of the rotating brush contact region, and at least portions of two contact region are overlapped with each other. Therefore, the cleaning electric field can effectively act on the toner on the belt member at the separation point where the toner on the belt member is separated by the rotating brush, while the abnormal discharge is suppressed from occurring. The cleaning device can be miniaturized, and the cleaning performance thereof can be enhanced.

Further, using such a cleaning device, the image forming apparatus whose cleaning performance is excellent can be provided.

The cleaning device according to the first and second embodiments, it is necessary not only to clean a toner remaining on a surface of an intermediate transfer belt, that is, a large amount of toner before transfer and a small amount of residual toner after transfer but also to clean a toner having a normal charge polarity and a toner having a polarity opposite to the normal charge polarity. Therefore, the cleaning device has a biasing unit applying bias voltages having polarities different from each other to at least two of the plurality of brush rolls, respectively.

Besides, in the case of the cleaning device according to the first and second embodiments, among the plurality of brush rolls, the surface circulating speed of the brush roll to which the bias having the polarity opposite to the normal charge polarity of the toner is applied is set higher than that of the brush roll to which the bias having the same polarity as the normal charge polarity of the toner is applied. Therefore, by the stopping effect of the brush roll of which the surface circulating speed is set low, a toner cloud due to the rotation is prevented a small amount of toner having a small charge amount of toner that is difficult to be cleaned. Also, the brush roll of which the surface circulating speed is set high removes a large amount toner.

Therefore, in case of the cleaning device according to the first and second embodiments, the difference between the speeds may be large to drive the plurality of brush rolls by a common drive. Therefore, as explained hereinafter, a plurality of drive sources may be provided in the first and second embodiments so that the construction of the device is not complicated, and that the cost does not increase.

Fifth Embodiment

Figure 17:
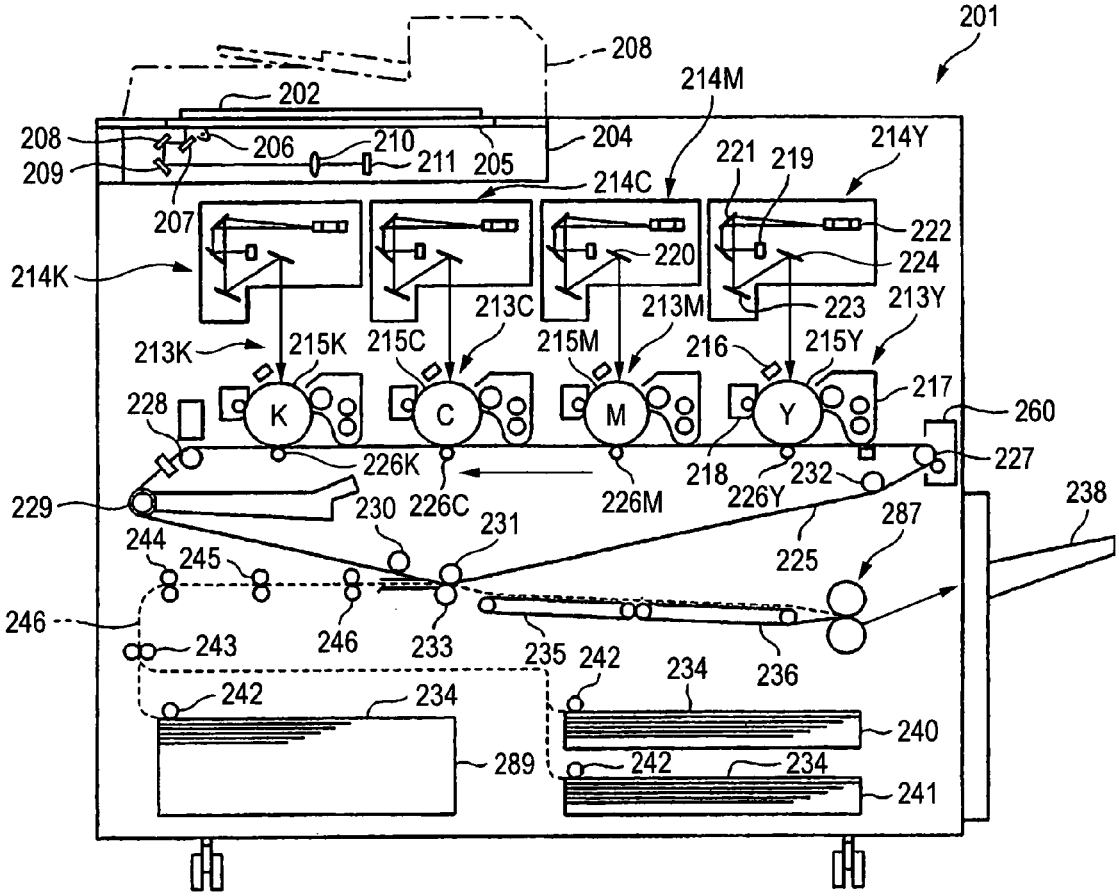
FIG. 17 shows the construction of a tandem type color copier as the image forming apparatus according to the fifth embodiment.

FIG. 17 shows a tandem type digital color copier as an image forming apparatus according to a fifth embodiment.

In FIG. 17, reference numeral 201 denotes a main body of the tandem type digital color copier. At the upper portion on one end side of the main body of the tandem type digital color copier 201, an automatic document feeder (ADF) 203 and a document reading device 204 are provided. The automatic document feeder 203 automatically feeds a document 202 sheet by sheet, and the document reading device 204 reads images of the document 202 fed by the automatic document feeder. In the document reading device 204, a document 202 mounted on a platen glass 205 is irradiated by a light source 206, and the reflected light image from the document 202 is projected onto an image reading element 211 including CCDs or the like through a demagnification optical system composed of a full-rate mirror 207, half-rate mirrors 208 and 209, and an imaging lens 100. A color material reflected light image of the document 202 is read by the image reading element 211 at predetermined dot density (for example, 16 dot/mm).

The color material reflected light image of the document 202 read by the document reading device 204 is sent to IPS 12 (Image Processing System), for example, as document reflectivity data of three colors of red (R), green (G), and blue (B). The IPS 12 performs predetermined image processing such as shading correction, position shift correction, lightness/color space conversion, gamma correction, frame erasion, color/move edit, etc., on the document reflectivity data.

The image data undergone the predetermined image processing by the image processing system 12 as described above is converted into 4-color document color material grayscale data of yellow (Y), magenta (M), cyan (C), and black (K) (each eight bits) and sent to ROSs (raster output scanners) 214Y, 214M, 214C, and 214K of image forming units 213Y, 213M, 213C, and 213K of yellow (Y), magenta (M), cyan (C), and black (K). In these ROSs (raster output scanners) 214Y, 214M, 214C, and 214K, an image is exposed by a laser beam in response to the document color material grayscale data.

Meanwhile, inside the tandem type digital color copier 1, four image forming units 213Y, 213M, 213C, and 213K of yellow (Y), magenta (M), cyan (C), and black (K) are arranged in parallel at predetermined intervals in the horizontal direction.

Any of these four image forming units 213Y, 213M, 213C, and 213K has the same construction and is roughly constructed by a photosensitive drum 215 rotating in an arrow direction at a predetermined rotation speed, a primary charging scorotron 216 to uniformly charge the surface of the photosensitive drum 215, a ROS (Raster Output Scanner) 214 to form an electrostatic latent image by exposing an image corresponding to each color onto the surface of the photosensitive drum 215, a developing device 217 to develop the electrostatic latent image formed on the photosensitive drum 215, and a cleaning device 218.

The ROS 14 modulates a semiconductor laser 219 in response to the document color material grayscale data and emits a laser beam LB from the semiconductor laser 219 in response to the grayscale data, as shown in FIG. 17. The laser beam LB emitted from the semiconductor laser 219 is deflected and scanned by means of a rotation polygon mirror 222 by way of reflective mirrors 220 and 221 and is scanned onto the photosensitive drum 215 serving as an image carrier by way of the reflective mirrors 220 and 221 and a plurality of reflective mirrors 223 and 224.

The IPS 212 sequentially outputs image data of the individual colors to the ROSs 214Y, 214M, 214C, and 214K of the image forming units 213Y, 213M, 213C, and 213K of yellow (Y), magenta (M), cyan (C), and black (K). Laser beams emitted corresponding to the image data from the ROSs 214Y, 214M, 214C, and 214K are scanned onto the surfaces of the photosensitive drums 215Y, 215M, 215C, and 215K so as to form electrostatic latent images. The electrostatic latent images formed on the individual photosensitive drums 215Y, 215M, 215C, and 215K are developed as toner images of yellow (Y), magenta (M), cyan (C), and black (K) by developers 217Y, 217M, 217C, and 217K.

The toner images of yellow (Y), magenta (M), cyan (C), and black (K), which are sequentially formed on the photosensitive drums 215Y, 215M, 215C, and 215K of the image forming units 213Y, 213M, 213C, and 213K, are multi-transferred, by first transfer rolls 226Y, 226M, 226C, and 226K, on an intermediate transfer belt 225 which serves as an image carrier and is disposed under the image forming units 213Y, 213M, 213C, and 213K. The transfer belt 225 is suspended to have a predetermined tension by a drive roll 227, a stripping roll 228, a steering roll 229, an idle roll 230, a backup roll 231, and an idle roll 232. The drive roll 227 is rotationally driven by a dedicated drive motor (not shown), and thereby, the intermediate transfer belt 225 is circularly driven at a predetermined speed in an arrow direction. The intermediate transfer belt 225 may be formed in an endless belt shape by, for example, adding a conductant agent in polyimide resin so as to control the resistance.

The toner images of yellow (Y), magenta (M), cyan (C), and black (K), which are multi-transferred on the transfer belt 225, are secondarily transferred onto transfer paper 234 serving as a transfer material with by electrostatic force and the pressing contact force by a second transfer roll 233, which serves as a roll-shaped transfer member and is pressed into contact with the backup roll 231 opposite thereto. The transfer paper 234 where the individual color toner images have been transferred is conveyed to a fixing unit 237 by two consecutive conveying belts 235 and 236. Then, the transfer paper 234 where the individual color toner images have been transferred is subject to a fixing process with heat and pressure by the fixing unit 237 and then is discharged onto a discharge tray 238 provided outside the copier main body 201.

As for the transfer paper 234, transfer paper having a predetermined size is first conveyed from any of a plurality of paper feeding cassettes 239, 240, and 241 to a resist roll 246 through a paper conveying path including a paper feeding roll 242 and paper conveying roller pairs 243, 244, and 245, as shown in FIG. 17. The transfer paper 234 fed from any of the paper feeding cassettes 239, 240, and 241 is sent onto the intermediate transfer belt 225 by the resist roll 246 rotationally driven at a predetermined timing.

Figure 18:
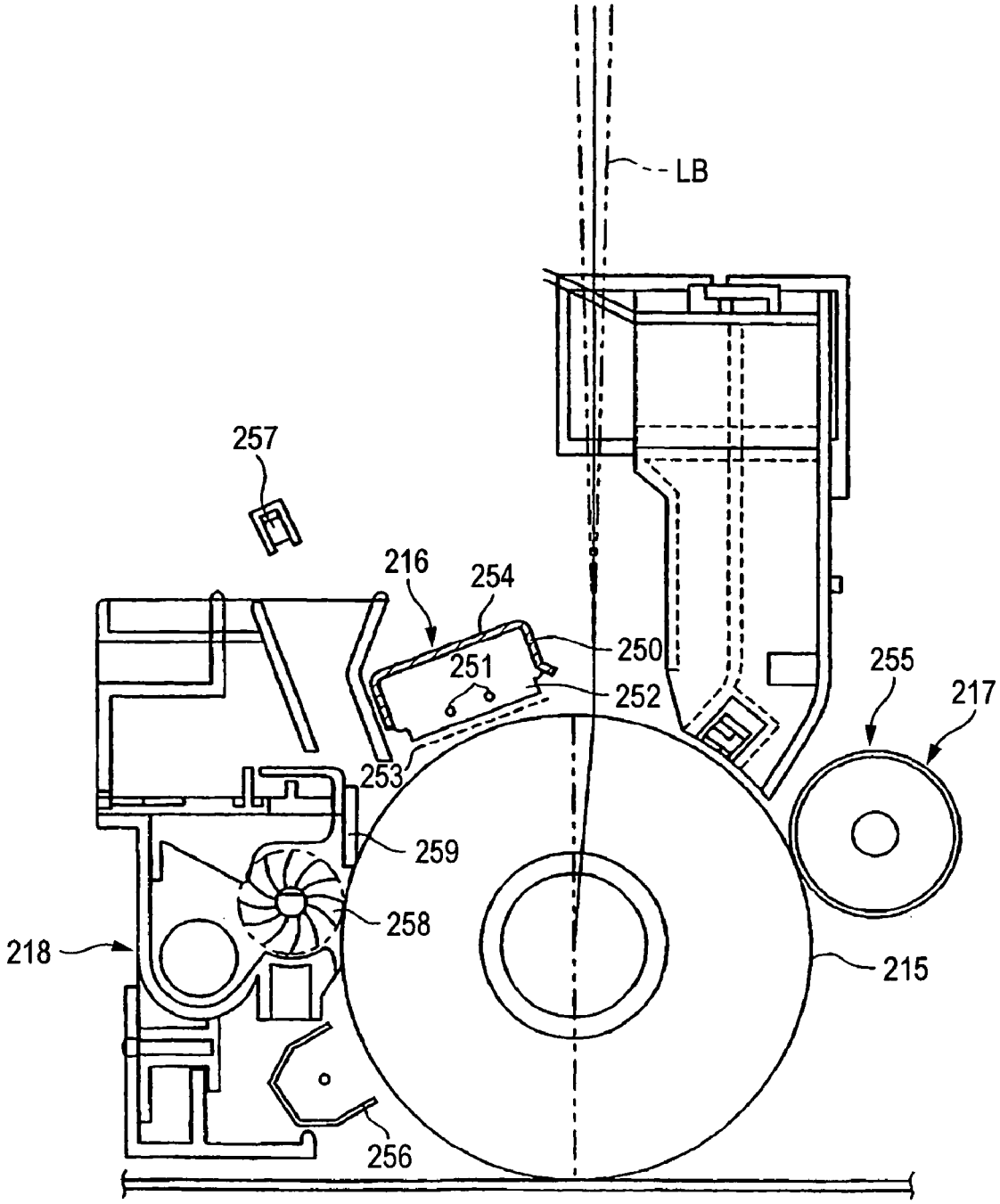
FIG. 18 shows an image forming unit of the tandem type color copier as the image forming apparatus according to the fifth embodiment.

FIG. 18 shows each image forming unit of the tandem type digital color copier.

The four image forming units 213Y, 213M, 213C, and 213K of yellow, magenta, cyan, and black have the same construction as shown in FIG. 3. In the four image forming units 213Y, 213M, 213C, and 213K, as described above, the toner images of yellow, magenta, cyan, and black are sequentially formed at predetermined timings. The image forming units 213Y, 213M, 213C, and 213K of individual colors respectively have the photosensitive drums 215Y, 215M, 215C, and 215K, as described above. The surfaces of the photosensitive drums 215Y, 215M, 215C, and 215K are uniformly charged by the primary charging scorotrons 216Y, 216M, 216C, and 216K or a charging roll. Each scorotron 216Y, 216M, 216C, and 216K is composed of a discharge shield 250 formed into a frame shape that has a rectangular section and is opened at the side of the photosensitive drum 215, two wires 251 extended in the discharge shield 250, and a grid electrode 253 disposed outside of an opening portion 252 of the discharge shield 250. Further, in each of the primary charging scorotrons 216Y, 216M, 216C, and 216K, an elongated opening portion 254 is formed in the rear surface of the discharge shield 250 on one end side of the width direction along the longitudinal direction. A blower (not shown) sends air into the scorotron 216 through the opening portion 254.

After uniformly charged by the primary charging scorotrons 216Y, 216M, 216C, and 216K, the surfaces of the photosensitive drums 215Y, 215M, 215C, and 215K are subjected to scanning and exposure of the laser beam LB for image formation emitted from the ROSs 214Y, 214M, 214C, and 214K in accordance with the image data such that the electrostatic latent images corresponding to the respective colors are formed. The electrostatic latent images formed on the surfaces of the photosensitive drums 215Y, 215M, 215C, and 215K are developed with toners of yellow, magenta, cyan, and black by the developing rolls 255 of the developing units 217Y, 217M, 217C, and 217K of the respective image forming units 213Y, 213M, 213C, and 213K so as to be visible toner images. These visible toner images are sequentially multi-transferred onto the intermediate transfer belt 225 by charging of the transfer rolls 226Y, 226M, 226C, and 226K.

After the transfer step of the toner images is ended, the charge of the surfaces of the photoreceptor drums 215Y, 215M, 215C, and 215K is removed by pre-cleaning scorotrons 256Y, 256M, 256C, and 256K. Then, residual toner, paper powder, and the like are removed by cleaning devices 218Y, 218M, 218C, and 218K and the residual charge is completely removed by erase lamps 257Y, 257M, 257C, and 257K such that preparation for a next image forming process is made. Each of cleaning devices 218Y, 218M, 218C, and 218K has a cleaning brush 258 and a cleaner blade 259, and the residual toner, paper powder, and the like on the photoreceptor drum 215 are removed by the cleaning brush 258 and the cleaner blade 259.

In the fifth embodiment, the cleaning device for cleaning the toner attached on the surface of the image carrier includes a plurality of brush rolls, which is contact with the surface of the image carrier, and a biasing unit, which applies bias voltages having different polarities to at least two of the brush rolls. In the present embodiment, among the brush rolls, a brush roll, to which a bias voltage having a polarity opposite to a normal electrified polarity of the toner is applied, is set to be faster in surface circulating speed than a brush roll, to which a bias voltage having the same polarity as the normal electrified polarity of the toner is applied.

According to the fifth embodiment, the image carrier is constructed to be an intermediate transfer member where the toner images from the photosensitive drums are multi-transferred.

Furthermore, in the fifth embodiment, the brush roll slowly rotating is driven intermittently.

That is, as shown in FIG. 17, in the fifth embodiment, removing a toner attached on the intermediate transfer belt 225 serving as the image carrier, a cleaning device 260 for an intermediate transfer belt is provided. The cleaning device 260 for the intermediate transfer belt is provided at a position corresponding to the intermediate transfer belt 225 wound on the periphery of a drive roll 227.

The cleaning device 260 for the intermediate transfer belt has a plurality of (two in the fifth embodiment) brush rolls 261 and 262 each composed of a conductive brush. These first and second brush rolls 261 and 262 are constructed to rotate at different speeds (peripheral speeds) in the opposite direction to the movement of the intermediate transfer belt 225.

The speed of the first brush roll 261 is set high and the speed of the second brush roll 262 is set very low. The first brush roll 261 is rotated at a speed, for example, with a peripheral speed ratio R (brush speed/belt speed) of 1.0 in the direction opposite to the moving direction of the intermediate transfer belt 225. The peripheral speed ration R may be $0.5 \leqq R \leqq 1.5$.

Figure 19:
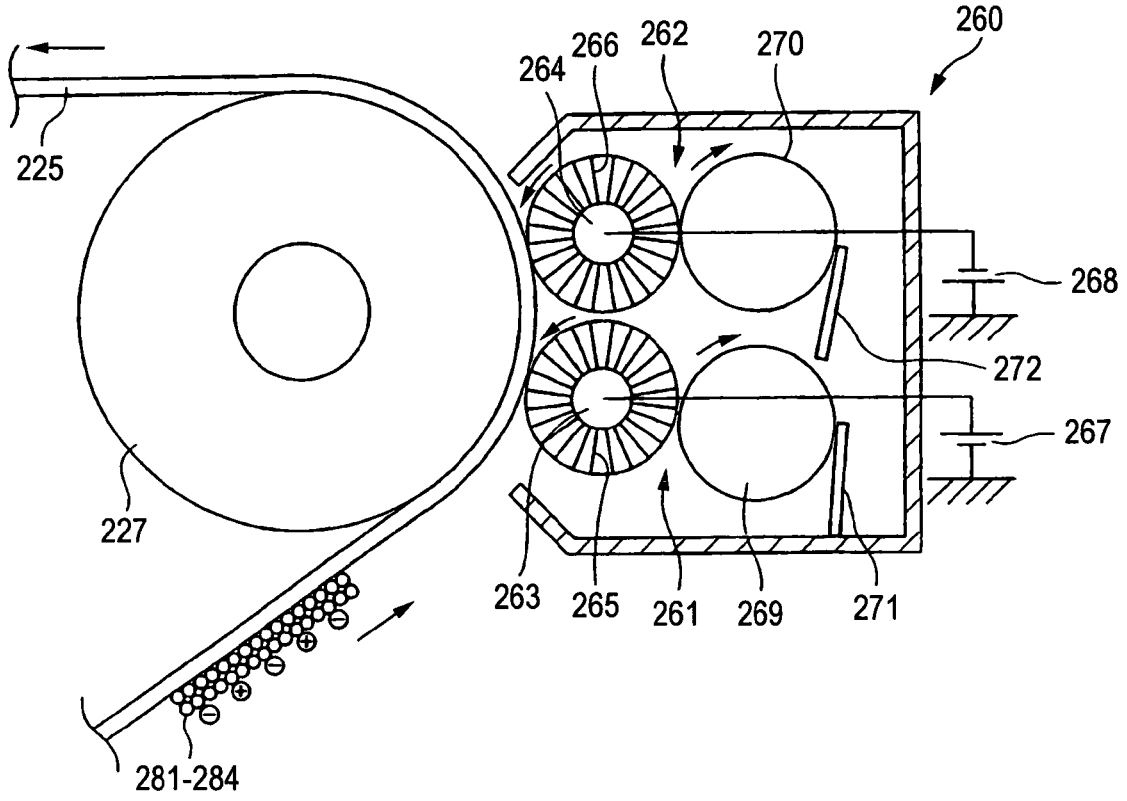
FIG. 19 shows the construction of a main part of the color copier as the image forming apparatus according to the fifth embodiment.

As shown in FIG. 19, each of the first and second brush rolls 261 and 262 is formed of a cylindrical brush in which brush fibers 265 and 266 having a predetermined diameter are planted with a predetermined density on the periphery of each of conductive shafts 263 and 264 made of metal or conductive synthetic resin. The brush fibers 265 and 266 used in the first and second brush rolls 261 and 262 are made of conductive fibers including a base material, such as nylon, acryl, polyester, or rayon, combined with a conductive material, such as carbon black. In the fifth embodiment, a conductive nylon is used. Even though each of the brush fibers 265 and 266 has a thickness of 6 deniers (D) in the fifth embodiment, the brush fiber having a thickness of 0.1~15 deniers may be used.

Each of the first and second brush rolls 261 and 262 has a brush density having more than a predetermined value to block the toner in a low speed. When the density is F [numbers/inch$^2$] and the thickness of fiber is D [denier], it is preferably set to $F/D \geqq 10$. In the present embodiment, the thickness of fiber is set to 6 [deniers] and the density is 150 [numbers/inch$^2$], such that $F/D=25$.

The first and second brush rolls 261 and 262 can be set to various diameters. In the present embodiment, the brush has a diameter of 16 mm, the shaft has a diameter of 10 mm, and a length PH of brush including brush cloth is set to 3 mm. In addition, the bite amount DP of the first and second brush rolls 261 and 262 to the surface of the intermediate transfer belt 225 is set to 0.8 mm. In addition, the ratio of the bite amount DP to the length of brush PH may be set to $0.1 \leqq DP/PH \leqq 0.5$.

Bias voltages having different polarities from each other are applied to the first and second brush rolls 261 and 262 by biasing units 267 and 268, respectively. A positive bias voltage (for example, about +300 V), which has a polarity opposite to the normal electrified polarity (negative polarity) of the toner, is applied to the first brush roll 261 disposed at an upstream of the movement direction of the intermediate transfer belt 225 by a DC voltage source 267 serving as a biasing unit. In addition, a negative bias voltage (for example, about −300 V), which has the same polarity as the normal electrified polarity (negative polarity) of the toner, is applied to the second brush roll 262 disposed at a downstream of the movement direction of the intermediate transfer belt 225 by a DC voltage source 268 serving as a biasing unit. The bias voltages applied to the first and second brush rolls 261 and 262 are not limited to the above-mentioned voltage values.

In addition, as shown in FIG. 19, the first and second brush rolls 261 and 262 are arranged to contact collecting rolls 269 and 270, respectively, which collect toner removed by the first and second brush rolls 341 and 342. The collecting rolls 269 and 270 are made of a synthetic resin, such as conductive phenol resin, or a metallic material. The collecting rolls 269 and 270 have a diameter $\phi$ of 12 mm and have a potential difference (voltage applied to the collecting roll−voltage applied to the brush) from the brush rolls 261 and 262. A potential difference of +400 V is set between the first brush roll 261 and the first collecting roll 269 by a voltage source (not shown), and a potential difference of −400 V is set between the second brush roll 262 and the second collecting roll 270 by a voltage source (not shown. The collecting rolls 269 and 270 have a speed different from the brush rolls 261 and 262. For example, the collecting rolls 269 and 270 are set to rotate at a speed of 1.3 times that of the brush rolls 261 and 262. The biting amount of the brush rolls 261 and 262 and the collecting rolls 269 and 270 are set to be greater than that of the brush rolls 261 and 262 and the belt 225. The biting amount is set to 0.9 mm in the fifth embodiment.

The toner collected by the first and second collecting rolls 269 and 270 is gathered by collecting roll blades 271 and 272. The collecting roll blades 271 and 272 are made of an elastic material, a resin material, or a metallic material. In the fifth embodiment, the collecting roll blades 271 and 272 are formed of a thin plate made of SUS having a thickness of 0.1 mm.

Figure 16A:
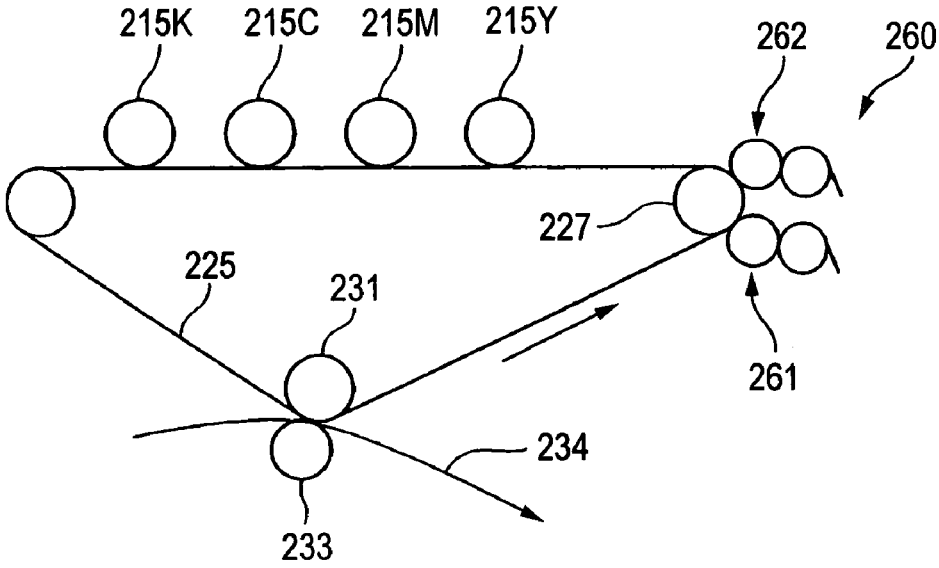
FIGS. 16A, 16B show the schematic construction of a color copier as an image forming apparatus according to a fifth embodiment of the invention.
Figure 16B:
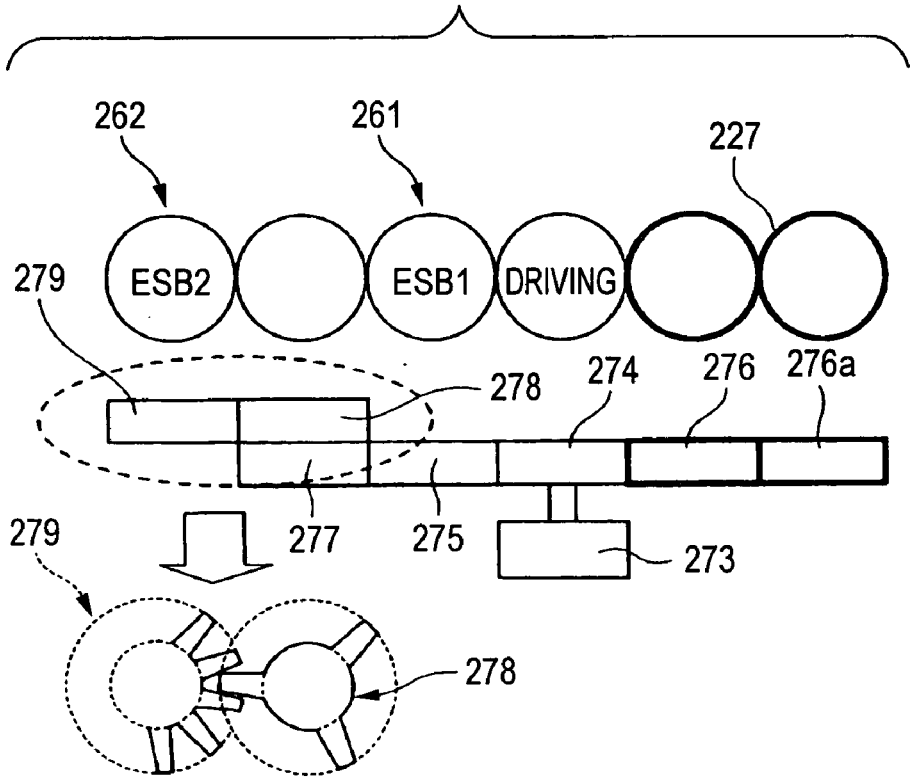

Meanwhile, the cleaning device 260 for the intermediate transfer belt is constructed as shown in FIG. 16A, 16B such that the first brush roll 261 and the second brush roll 262 are rotationally driven by a drive motor 273 serving as the same drive source. A drive gear 274 is fixed to the drive shaft of the drive motor 273, and a first driven gear 275, which is fixed to an end of the first brush roll 261, is engaged with the drive gear 274. Further, a gear 276*a*, which is fixed to an end of the drive roll 227 driving the intermediate transfer belt 225 to revolve, is engaged with the drive gear 274 by an intermediate gear 276. Furthermore, a second driven gear 277 is engaged with the first driven gear 275, and a third driven gear 278 for distributing driving force is concentrically mounted to the second driven gear 277. The third driven gear 278 is for intermittently drive the second brush roll 262 to rotate and has three teeth spaced 120 degrees apart as shown in FIG. 16B. The third driven gear 278 is engaged with a fourth driven gear 279 fixed to an end of the second brush roll 262.

According to the above-mentioned construction, since the residual toner distributed widely quantitatively and electrostatically is completely cleaned in the tandem type digital color copier using the cleaning device according to the fifth embodiment by the following way. Therefore, in the cleaning device having a plurality of brush rolls at different surface circulating speeds, it is possible to drive the plurality of brush rolls while preventing the structure of the device from becoming complicated or from increasing the cost.

That is, as shown in FIG. 17, in the tandem type printer according to the fifth embodiment, the toner images of the colors of yellow (Y), magenta (M), cyan (C), and black (K) are sequentially formed on the photosensitive drum 225 through an electronic photo process. The toner images of the colors of yellow (Y), magenta (M), cyan (C), and black (K) sequentially formed on the photosensitive drum are primarily transferred on the intermediate transfer belt 225 at the primary transfer position, and are secondarily collectively transferred from the intermediate transfer belt 225 to the recording paper 234 by the secondary transfer roll 233 at the secondary transfer position T2.

At this time, a very high bias voltage for transfer is applied to the secondary transfer roll 233 to collectively transfer the toner images of the colors of yellow (Y), magenta (M), cyan (C), and black (K) transferred on the intermediate transfer belt 225 to the recording paper 234, such that the toner images having multiple colors on the intermediate transfer belt 306 are transferred to the recording paper 234. As shown in FIG. 19, part of the multi-colored toner images carried on the intermediate transfer belt 225 is electrified to a positive polarity due to discharge generated by the very high bias voltage for transfer and is attached on the intermediate transfer belt 25, such that retransfer 281 exists. In addition, even though the polarity is not reversed by the bias voltage for transfer, the amount of electrified charge is almost equal to zero, such that only a small amount of transfer residual toner 282 remains on the intermediate transfer belt 225.

Figure 20:
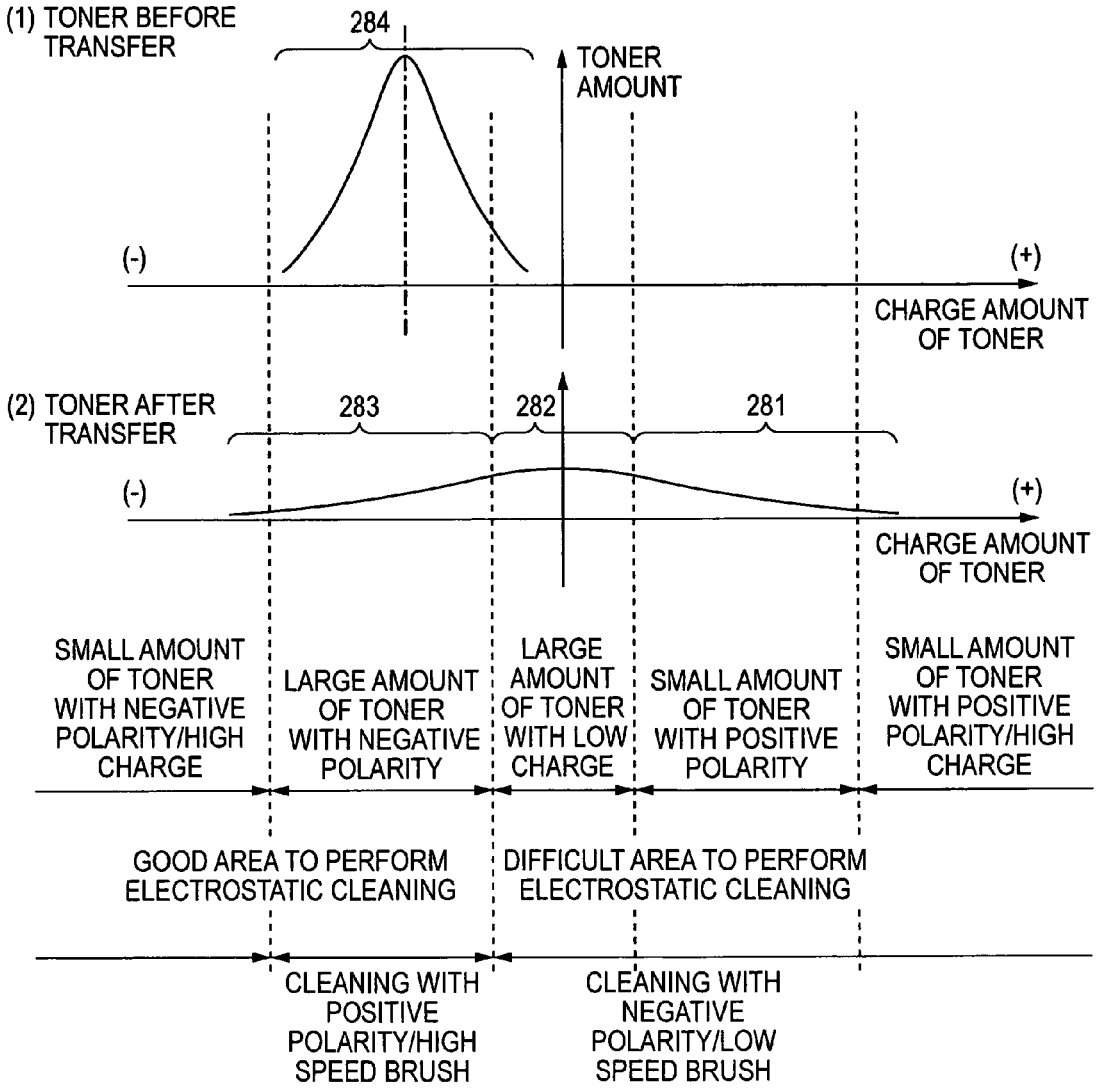
FIG. 20 schematically shows an amount and charging amount of toner remaining on an intermediate transfer belt.

As shown in FIG. 20, only a small amount of transfer residual toner 28 remains on the intermediate transfer belt 225 which is electrified with a negative polarity.

Further, in the tandem type digital color copier, when any image is not formed, toner images 291Y, 291M, 291C, and 291K for concentration control or toner images 292Y, 292M, 292C, and 292K for registration control are formed on the intermediate transfer belt 225 but are not transferred onto transfer paper 234. Therefore, the toner images remains as a large amount of untransferred toner 284.

As shown in FIG. 17, in the full-color printer, in case the recording paper 234 to be fed is not fed to the secondary transfer position T2 due to jam, the toner images of the colors of yellow (Y), magenta (M), cyan (C), and black (K) transferred on the intermediate transfer belt 225 may remain on the recording paper 234 as the non-transfer toner 284.

As shown in FIG. 20, in the full-color printer, since the transfer residual toners 281 to 283 or the non-transfer toner 284 having a wide distribution of the amount of toner or the electrified amount of toner remain on the intermediate transfer belt 225, the transfer residual toners 281 to 283 or the non-transfer toner 284 are cleaned by the cleaning device 260 for the intermediate transfer belt as shown in FIGS. 16A, 16B and 17.

As shown in FIGS. 16A, 16B, the cleaning device 260 for the intermediate transfer belt includes the first and second brush rolls 261 and 262. Among the transfer residual toners 281 to 283 or the non-transfer toner 284 that remain on the intermediate transfer belt 225, a large amount of non-transfer toner 284, which is electrified with a normal polarity, or a small amount of non-transfer toner 284, which is electrified with a normal polarity, are provided on an upstream of the movement direction of the intermediate transfer belt 225, and as described in FIG. 20, are absorbed to the brush fiber 263 of the first brush roll 261 by the high-speed rotating first brush roll 261 to which a positive bias voltage is applied, and are rotated at a high speed, and collected and removed by the next brush fiber 263.

Accordingly, in the first brush roll 261, the negative-polarity non-transfer toner 284 or transfer residual toner 283, which is electrified with a normal polarity, is absorbed to the brush fiber 263 by a coulomb force $F \propto q/r$ (r denotes a distance between a toner particle and the brush fiber 263) due to a difference with the amount of charge q of the brush fiber 263. In addition, since the first brush roll 261 rotates at a high speed, the number of brush fibers 263 contacting the surface of the intermediate transfer belt 225 per unit times is large, thereby completely removing the toner by the brush fibers 263.

In addition, since the first brush roll 261 rotates at a high speed, a large sliding friction acts on the non-transfer toner 284 or the toner residual toner 283 remaining on the intermediate transfer belt 225. Thus, it is possible to efficiently remove the non-transfer toner 284 or the transfer residual toner 283 remaining on the intermediate transfer belt 225.

In addition, since the negative-polarity non-transfer toner 284 or transfer residual toner 283, which is electrified with the normal polarity, is not strongly attached to the intermediate transfer belt 225, it is possible to securely remove the toner by the first brush roll 261 rotating in a high speed.

On the other hand, the transfer residual toner 281, which is electrified with a positive polarity opposite to the normal polarity and remains on the intermediate transfer belt 225, or the transfer residual toner 282, which has almost no electrified charge, flows into the first brush roll 261, and the transfer residual toner 281, which is electrified with a positive polarity opposite to the normal polarity, or the transfer residual toner 282, which has almost no electrified charge, is partly removed due to the sliding friction of the first brush roll 261 but mostly remains on the intermediate transfer belt 225.

Among the transfer residual toner 281 electrified with the positive polarity opposite to the normal polarity or the transfer residual toner 282 having almost no electrified charge, a toner passing through the first brush roll 261 reaches the second brush roll 262 provided on a downstream.

As shown in FIG. 20, since a negative bias voltage is applied to the second brush roll 262, the transfer residual toner 281 electrified with a positive polarity opposite to the normal polarity, among the transfer residual toner 281 electrified with a positive polarity opposite to the normal polarity or the transfer residual toner 282 having almost no electrified charge, is absorbed and removed by the second brush roll 342.

Figure 21:
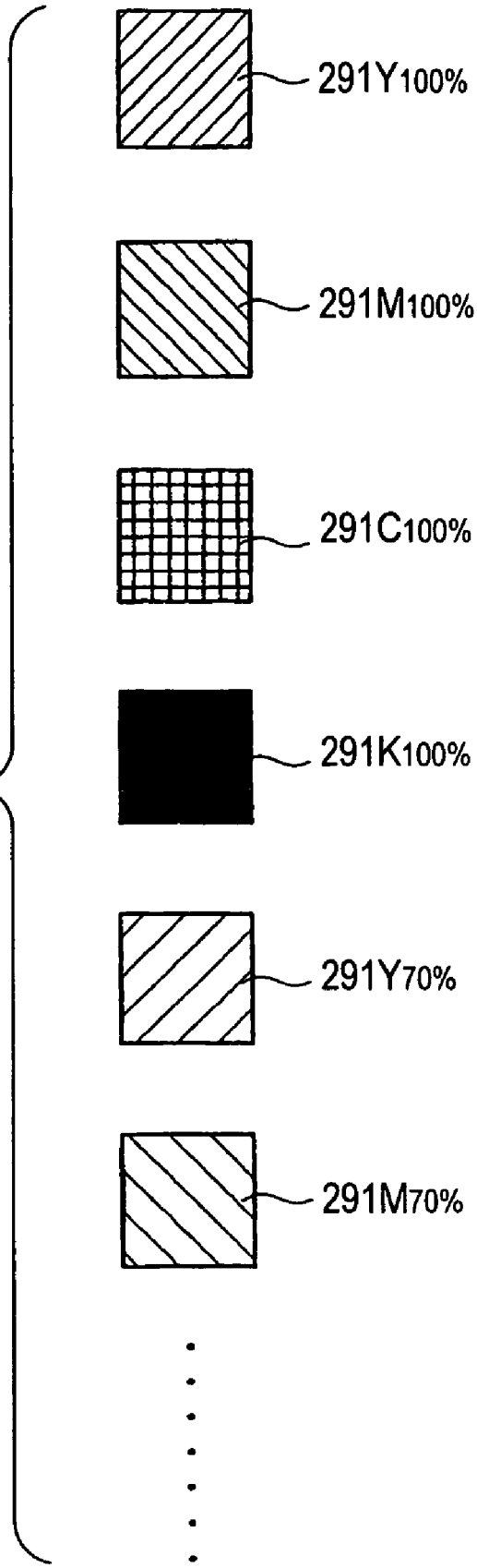
FIG. 21 shows the construction of a toner image for process control that is transferred on the intermediate transfer belt.
Figure 22:
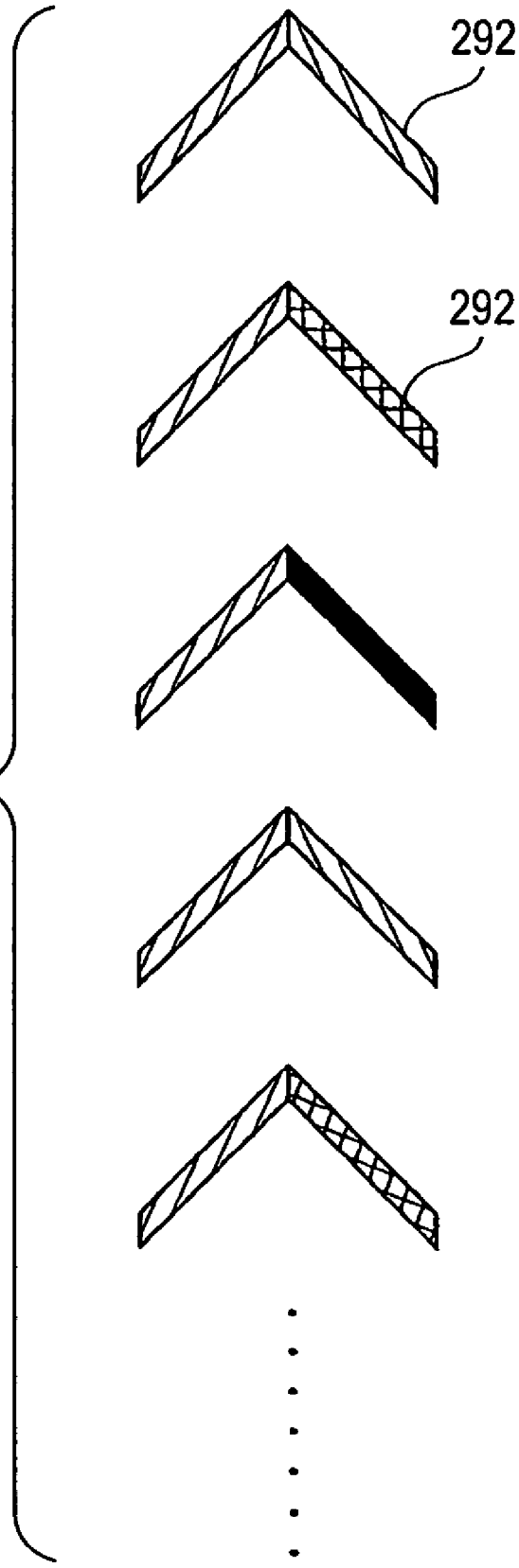
FIG. 22 shows the construction of a toner image for color resist control that is transferred on the intermediate transfer belt.
Figure 23:
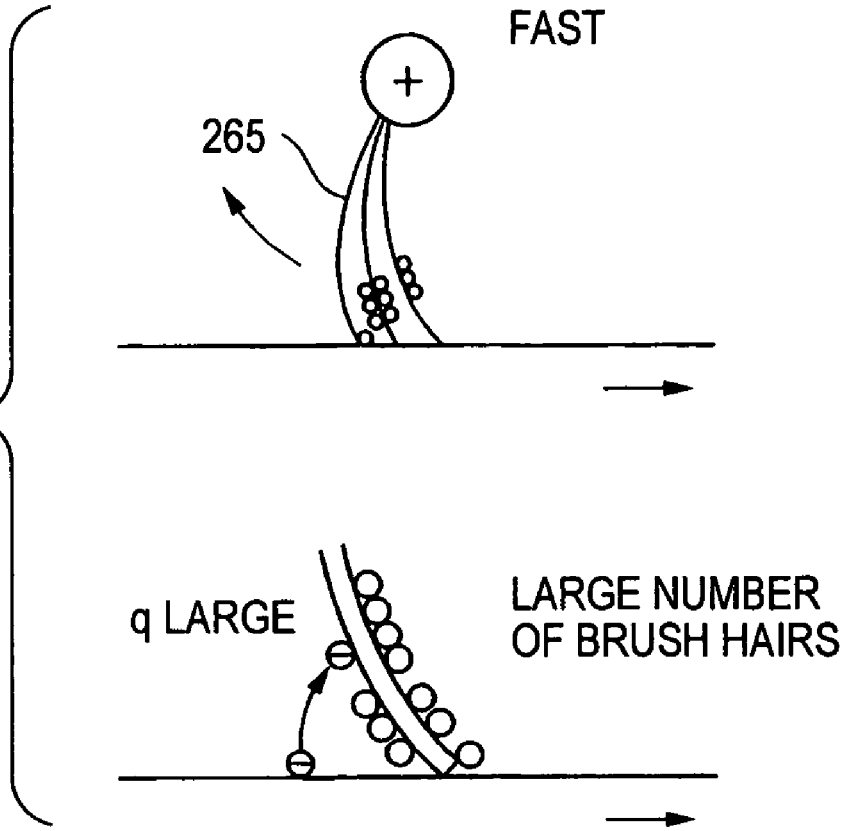
FIG. 23 illustrates the effect of a brush roll of a cleaning device for the intermediate transfer belt.
Figure 24:
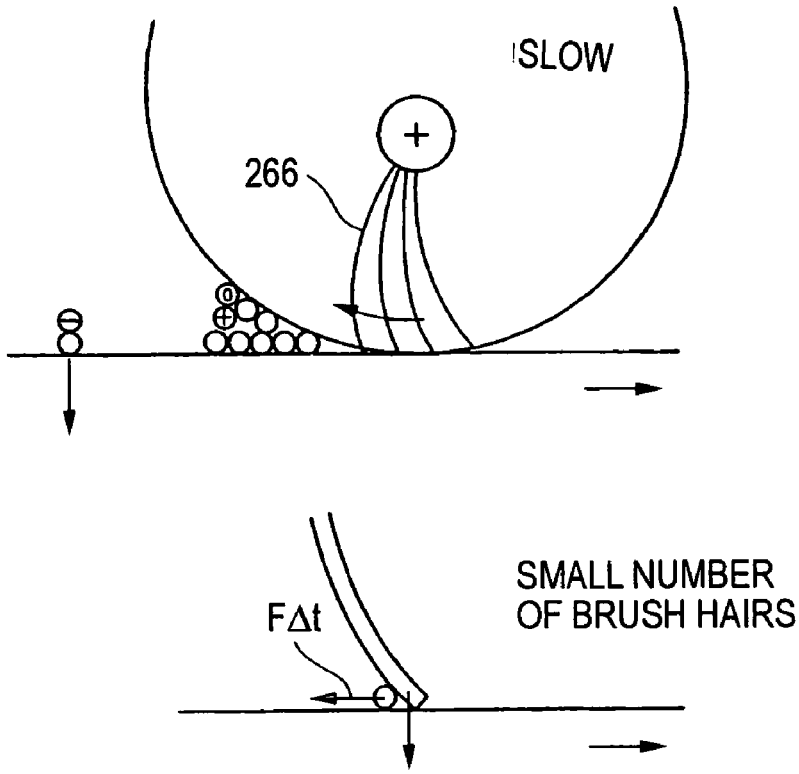
FIG. 24 illustrates the effect of the brush roll of the cleaning device of the intermediate transfer belt.

As shown in FIG. 21, since the second brush roll 262 rotates in a low speed, a time Δt in which an elastic force F of a single brush fiber 266 is applied to toner attached on a surface of the intermediate transfer belt 225 is longer than the first brush roll 261, and a mechanical impulse FΔt the brush fiber 266 affects the transfer residual toner 282 is large. It is possible to block the transfer residual toner 282 having almost no electric charge on the intermediate transfer belt 225 and remove the toner by a mechanical sliding friction produced when a plurality of brush fibers 266 is contact with the surface of the intermediate transfer belt 255 in a blade shape.

In addition, since the second brush roll 262 rotates at a low speed, unlike a typical cleaning blade, a new brush fiber 266 slowly is contact with the surface of the intermediate transfer belt 225, and the toner removed by the brush fiber 266 is collected and, at the same time, a cleaning operation is performed with a new brush fiber 266.

Thus, it is possible to securely remove the transfer residual toner 281 electrified with the positive polarity opposite to the normal polarity or the transfer residual toner 282 having almost no electrified charge by means of the second brush roll 342.

Further, in the cleaning device 260 for the intermediate transfer belt, the first brush roll 261 is rotationally driven by the drive motor and at the same time the second brush roll 262 is rotationally driven by the same drive motor through a driven gear, as shown in FIGS. 16A, 16B. Therefore, one drive source is required, thereby capable of simplifying the structure of the device and preventing the cost from increasing.

Furthermore, in the cleaning device 260 for the intermediate transfer belt, the second brush roll 262 is intermittently driven. Therefore, if the rotation drive amount of the second brush roll 262 is appropriately set, the second brush roll 262 having enough scraping force is intermittently rotated, whereby fresh brush fiber can be always brought into contact with the surface of the intermediate transfer belt 225 and enough cleaning force can be maintained.

Sixth Embodiment

Figure 25:
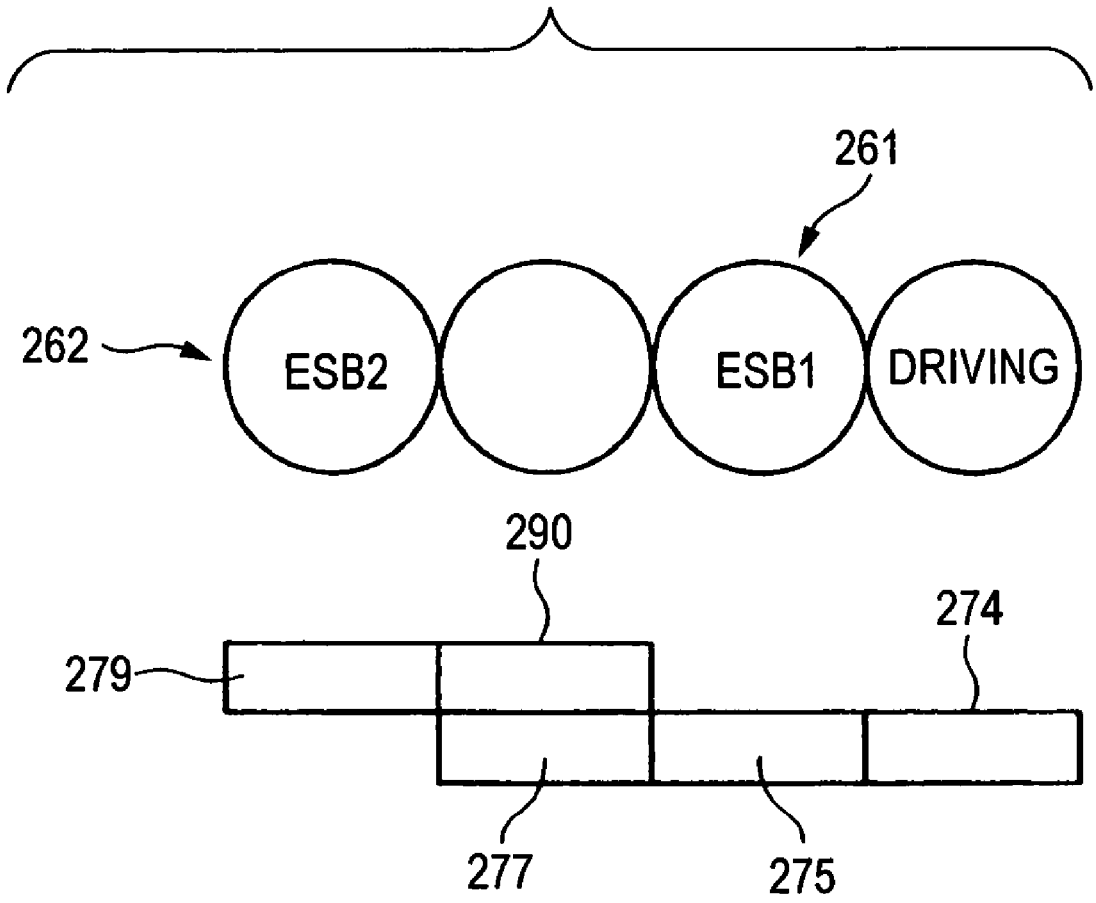
FIG. 25 schematically shows the construction of a color copier as an image forming apparatus according to a sixth embodiment of the invention.

FIG. 25 shows a sixth embodiment of the invention. The same parts as those in the fifth embodiment are denoted by the same numerals. In the sixth embodiment, the drive force of the drive source is transmitted to the brush roll of which the surface circulating speed is low through a clutch.

In other words, in the sixth embodiment, the second brush roller 262 is rotationally driven by the fourth driven gear 279 through an electromagnetic clutch 290 concentrically fixed to the drive roll 227.

Further, in the sixth embodiment, the electromagnetic clutch 290 is turned off in an image area such that the second brush roll 262 is in a fixed state (rotation prevention) and the electromagnetic clutch 290 is turned on in an inter-image section such that the second brush roll 262 is driven to rotate at a predetermined low speed.

As described above, in the sixth embodiment, the second brush roll 262 is made to be in a fixed state (rotation prevention) in the image area so as to effectively scrape the residual toner after transfer. Further, the second brush roll 262 is made to rotate in the inter-image section so as to recovery accumulated toner. Therefore, it is possible to always maintain good cleaning property.

Other construction and effect are the same as in the first embodiment and thus the description thereof will be omitted.

Seventh Embodiment

Figure 26A:
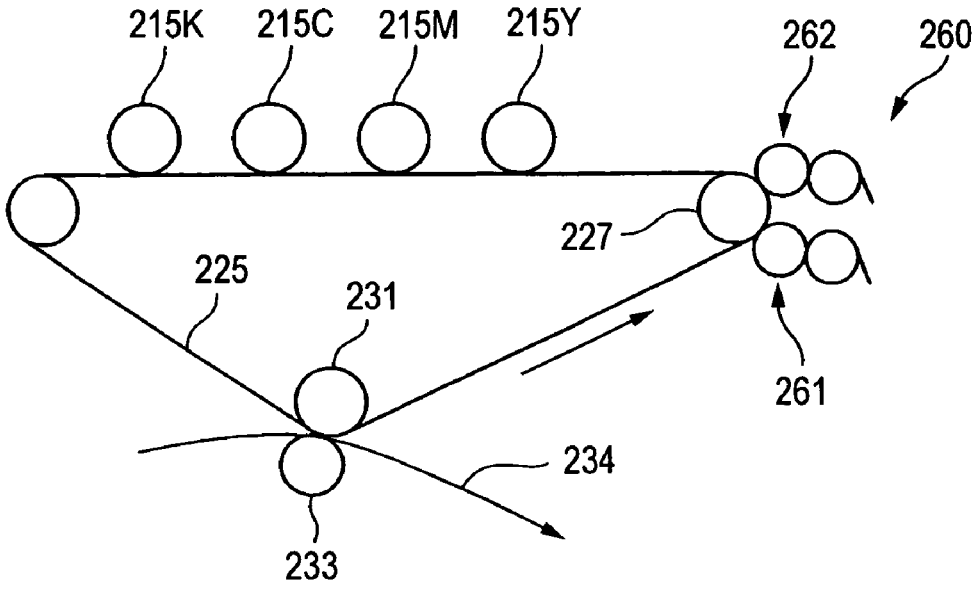
FIGS. 26A, 26B schematically show the construction of a color copier as an image forming apparatus according to a seventh embodiment of the invention.
Figure 26B:
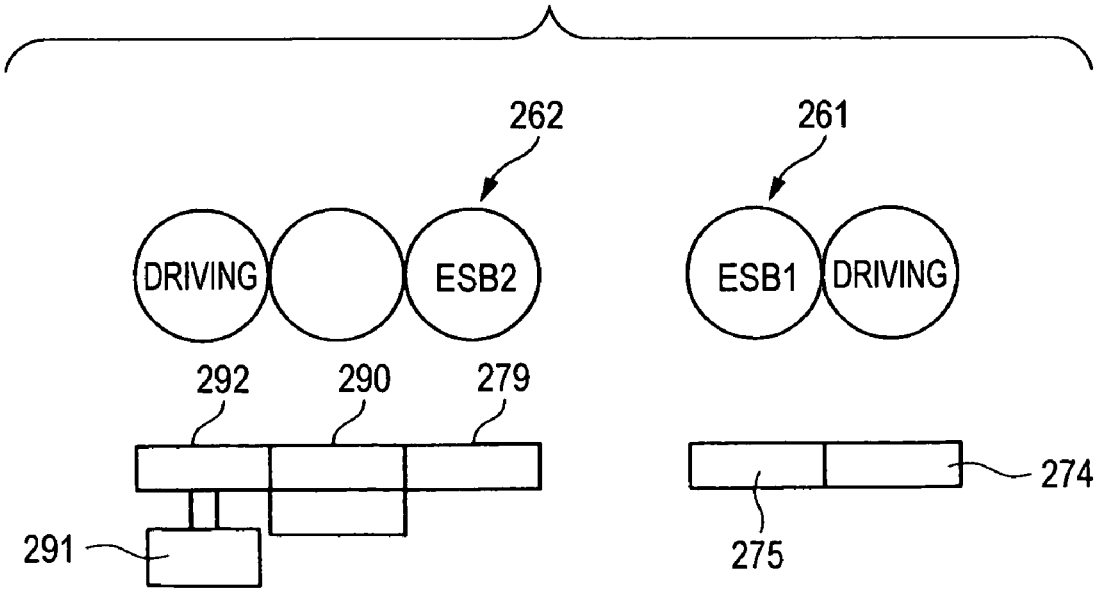
Figure 27:
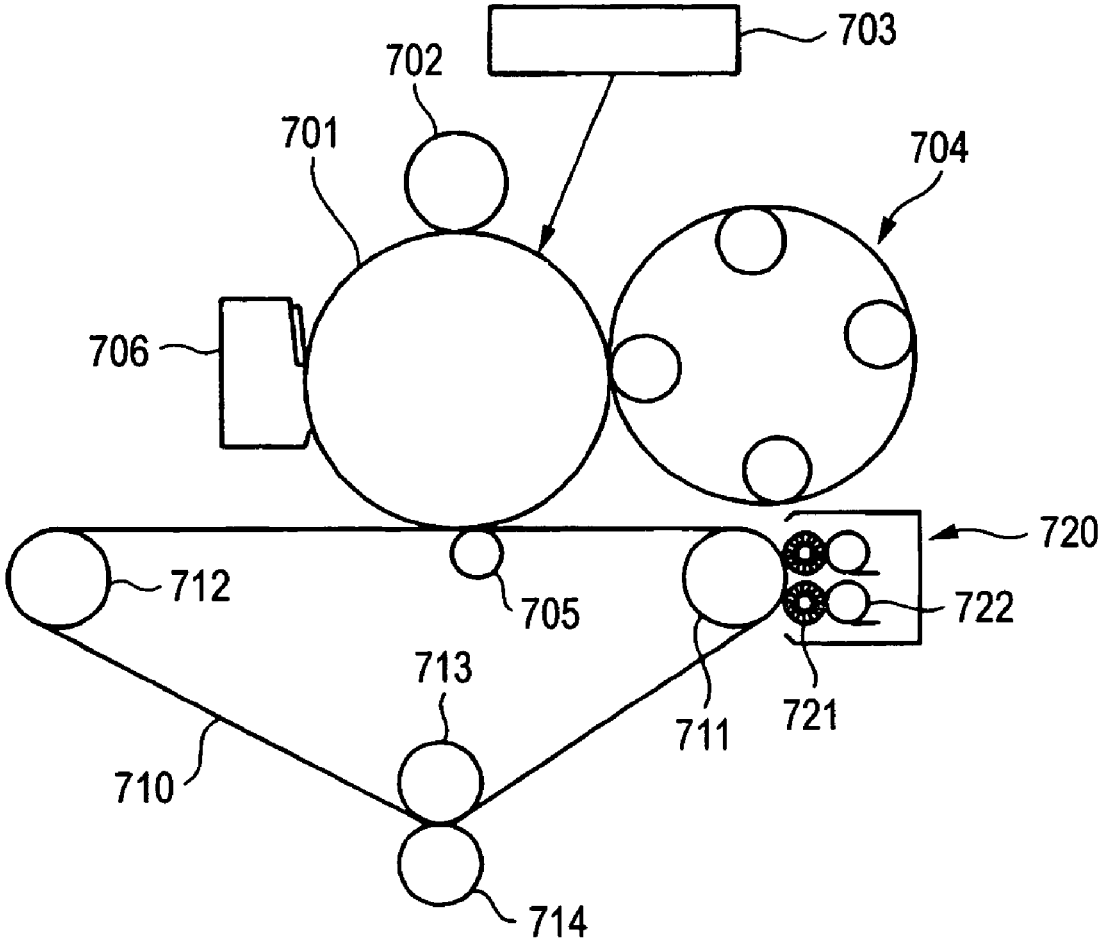
FIG. 27 is a diagram showing an image forming apparatus as a related art.

FIGS. 26A, 26B show a seventh embodiment of the invention. The same parts as those in the fifth embodiment are denoted by the same numerals. In the seventh embodiment, the brush roll of which the surface circulating speed is low is driven by the same drive source as a drive source driving other members.

In other words, in the seventh embodiment, the first brush roll 261 is rotationally driven by its own drive motor 291 and the second brush roll 262 obtains the drive force through an electromagnetic clutch from the drive motor rotationally the driving drive roll 227, as shown in FIGS. 26A, 26B.

The second brush roll 262 is fixed in an image area and is rotationally driven at a low speed in an inter-image section, as in the sixth embodiment.

As described above, even in the seventh embodiment, it is possible to drive a plurality of brush rolls of which surface circulating speeds are different from each other without increasing the number of drive sources, whereby the construction of the device is prevented from becoming complicated and the cost is preventing from increasing. Further, even in the seventh embodiment, the second brush roll 262 is made to be in a fixed state (rotation prevention) in the image area so as to effectively scrape the residual toner after transfer. Further, the second brush roll 262 is made to rotate in the inter-image section so as to recovery accumulated toner. Therefore, it is possible to always maintain good cleaning property.

Other construction and effect are the same as in the first embodiment and thus the description thereof will be omitted.

According to the embodiments, a cleaning device, which has a plurality of brush rolls having surface circulating speeds different from each other to completely clean a residual toner widely distributed quantitatively and electrostatically such that the construction of the device is prevented from becoming complicated and the cost is prevented from increasing, and which can drives the plurality of brush rolls having surface circulating speeds different from each other, and an image forming apparatus using the cleaning device.

According to the embodiments, the image carrier may be an intermediate transfer member where toner images are multi-transferred from photosensitive drums.

Further, the cleaning device according to the first aspect of the invention, the brush roll of which the surface circulating speed is low may be intermittently driven.

According to the embodiments, the drive source drives the brush roll of which the surface circulating speed is low and the image carrier which cleans the toner in the cleaning device, and the brush roll of which the surface circulating speed is high is driven by distributing the rotation drive force from the driving system of the image carrier.

According to the embodiments, the brush roll of which the surface circulating speed is low is driven by the same drive source as a drive source of the image carrier which cleans the toner in the cleaning device, and the brush roll of which the surface circulating speed is high is driven by another drive source.

According to the embodiments, an image forming apparatus is provided, which includes the cleaning device according to the embodiments.

According to the embodiments, it is possible to obtain a cleaning device, which has a plurality of brush rolls having surface circulating speeds different from each other to completely clean a residual toner distributed widely quantitatively and electrostatically such that the construction of the device is prevented from becoming complicated and the cost is prevented from increasing, and which can drives the plurality of brush rolls having surface circulating speeds different from each other, and an image forming apparatus using the cleaning device.

Figure 9A:
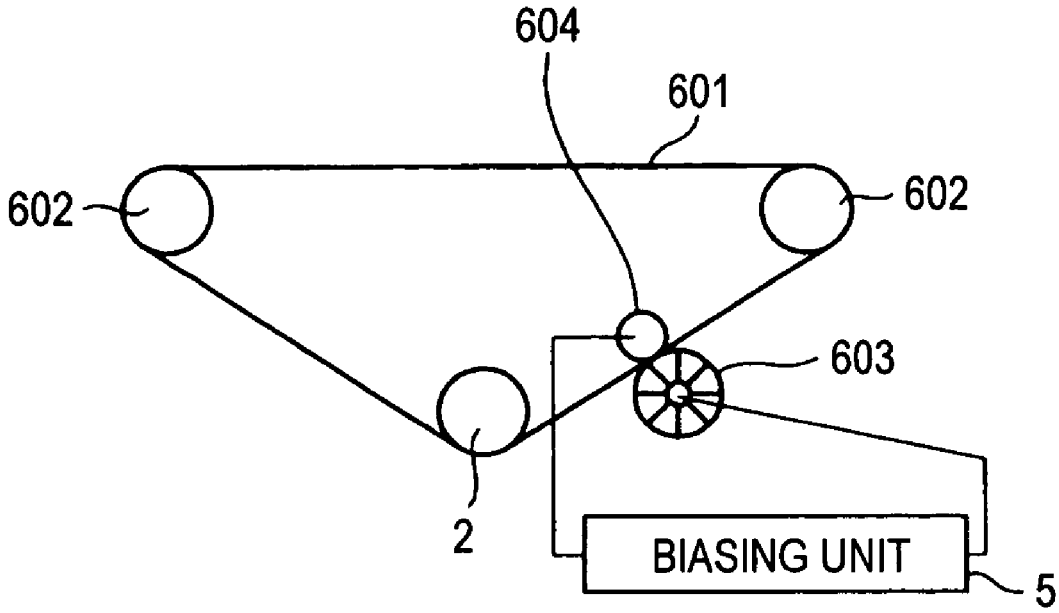
FIG. 9A is a diagram schematically showing a cleaning device.
Figure 9B:
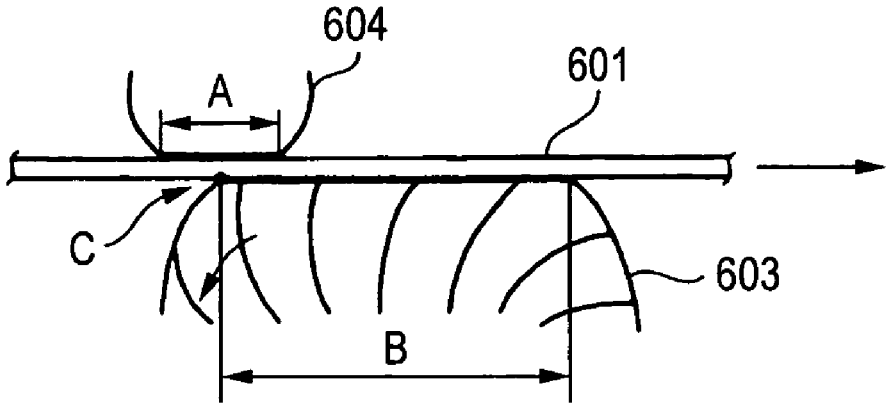
FIG. 9B is an enlarged view of the cleaning device.

According to another aspect, a cleaning device includes a belt member 601 that is stretched by a plurality of stretch members 602 so as to cycle; a rotating brush 603 that is in contact with the belt member 601 so as to clean the toner on the belt member 601; an counter member 604 that is disposed to facing the rotating brush 603 with the belt member 601 interposed therebetween; and a biasing unit 605 that is able to apply a cleaning bias between the rotating brush 603 and the counter member 604, as shown in FIGS. 9A and 9B. The width of an counter member contact region (A) where the counter member is in contact with the belt member 601, in a belt member conveying direction is narrower than that of a rotating brush contact region (B) where the rotating brush is in contact with the belt member 601, in the belt member conveying direction, the counter member contact region (A) is disposed to be biased to the exit side of the rotating brush contact region (B) in the rotation direction of the rotating brush, and at least a part of two contact regions is overlapped with each other. The width in the belt member conveying direction means the length of the belt member 601 along the conveying direction.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning device, comprising:

a plurality of brush rolls being in contact with a surface of an image carrier to which a toner is attached, wherein the image carrier is an intermediate transfer unit; and a biasing unit applying bias voltages having different polarities from each other to at least two of the brush rolls; wherein the cleaning device is configured to be disposed to face a tension roll; and the plurality of brush rolls including a first brush roll and a second brush roll, a bias having a polarity opposite to a normal polarity of the toner being applied to the first brush roll, a bias having the same polarity as the normal polarity of the toner being applied to the second brush roll, and a surface circulating speed of the first brush roll being set to be higher than the surface circulating speed of the second brush roll; wherein a direction of rotation of each of the plurality of brush rolls is opposite to a direction of rotation of the image carrier;

a speed of the first brush is no fewer than 0.5 times, and no more than 1.5 times of a speed of the image carrier; and a speed of the second brush is no fewer than 0.05 times, and no more than 0.5 times of the speed of the image carrier.

2. The cleaning device according to claim 1, wherein each of the plurality of brush rolls is formed of a conductive brush.

3. The cleaning device according to claim 1, wherein the first brush roll is positioned upstream of the second brush roll, with respect to the rotation direction of the image carrier.

4. An image forming apparatus comprising:

a plurality of brush rolls being in contact with a surface of an image carrier to which a toner is attached, wherein the image carrier is an intermediate transfer unit; and a biasing unit applying bias voltages having different polarities from each other to at least two of the brush rolls; wherein the plurality of brush rolls including a first brush roll and a second brush roll, a bias having a polarity opposite to a normal polarity of the toner being applied to the first brush roll, a bias having the same polarity as the normal polarity of the toner being applied to the second brush roll, and a surface circulating speed of the first brush roll being set to be higher than the surface circulating speed of the second brush roll;

a tension roll; and a cleaning device which is disposed to face the tension roll; wherein a direction of rotation of each of the plurality of brush rolls is opposite to a direction of rotation of the image carrier;

a speed of the first brush is no fewer than 0.5 times, and no more than 1.5 times of a speed of the image carrier; and a speed of the second brush is no fewer than 0.05 times, and no more than 0.5 times of the speed of the image carrier.

* * * * *